US009528336B2

(12) United States Patent
Jacob et al.

(10) Patent No.: US 9,528,336 B2
(45) Date of Patent: Dec. 27, 2016

(54) DEPLOYING AN EXPANDABLE DOWNHOLE SEAT ASSEMBLY

(71) Applicant: Schlumberger Technology Corporation, Sugar Land, TX (US)

(72) Inventors: Gregoire Jacob, Houston, TX (US); Pierre-Arnaud Foucher, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 531 days.

(21) Appl. No.: 14/029,918

(22) Filed: Sep. 18, 2013

(65) Prior Publication Data

US 2014/0216758 A1 Aug. 7, 2014

Related U.S. Application Data

(60) Provisional application No. 61/759,584, filed on Feb. 1, 2013, provisional application No. 61/759,592, filed (Continued)

(51) Int. Cl.

| | |
|---|---|
| ***E21B 34/14*** | (2006.01) |
| ***E21B 23/00*** | (2006.01) |
| ***E21B 43/10*** | (2006.01) |

(52) U.S. Cl.

CPC ..... *E21B 23/00* (2013.01); *E21B 34/14* (2013.01); *E21B 43/103* (2013.01); *E21B 43/105* (2013.01)

(58) Field of Classification Search

CPC ..... F16K 1/34; F16K 1/42

(Continued)

(56) References Cited

U.S. PATENT DOCUMENTS

| | | | |
|---|---|---|---|
| 2,315,931 | A | 4/1943 | Burt et al. |
| 3,011,548 | A | 12/1961 | Holt |

(Continued)

FOREIGN PATENT DOCUMENTS

| | | | |
|---|---|---|---|
| WO | 03095794 | A1 | 11/2003 |
| WO | 2004088091 | A1 | 10/2004 |

(Continued)

OTHER PUBLICATIONS

Thomson, D. W., and Nazroo, M. F., Design and Installation of a Cost-Effective Completion System for Horizontal Chalk Wells Where Multiple Zones Require Acid Stimulation, SPE 51177 (a revision of SPE 39150), Offshore Technology Conference, May 1997, Houston, TX, USA.

(Continued)

*Primary Examiner* — Jennifer H Gay
*Assistant Examiner* — Caroline Butcher
(74) *Attorney, Agent, or Firm* — Jeffery R. Peterson

(57) ABSTRACT

A method includes running an assembly on a tool in a contracted state into a well. The assembly includes segments that are adapted to be radially contracted and arranged in a first number of layers along a longitudinal axis of the assembly in the contracted state of the assembly. The technique includes using the tool to expand the assembly downhole in the well to transition the assembly between the contracted state and an expanded state. Using the tool to expand the seat assembly includes radially expanding the segments and longitudinally contracting the segments to arrange the layers in a second number of layers having at least one layer less than the first number.

17 Claims, 29 Drawing Sheets

Related U.S. Application Data on Feb. 1, 2013, provisional application No. 61/759,599, filed on Feb. 1, 2013, provisional application No. 61/759,577, filed on Feb. 1, 2013.

(58) Field of Classification Search
USPC ..... 251/359
See application file for complete search history.

(56) References Cited

U.S. PATENT DOCUMENTS

| | | | |
|---|---|---|---|
| 3,054,415 | A | 9/1962 | Baker et al. |
| 3,263,752 | A | 8/1966 | Conrad |
| 3,269,463 | A | 8/1966 | Page, Jr. |
| 3,995,692 | A | 12/1976 | Seitz |
| 4,064,937 | A | 12/1977 | Barrington |
| 4,355,686 | A | 10/1982 | Arendt |
| 4,372,384 | A | 2/1983 | Kinney |
| 4,499,951 | A | 2/1985 | Vann |
| 4,729,432 | A | 3/1988 | Helms |
| 4,771,831 | A | 9/1988 | Pringle et al. |
| 4,967,853 | A | 11/1990 | Landry |
| 5,069,280 | A | 12/1991 | McKee et al. |
| 5,183,114 | A | 2/1993 | Mashaw, Jr. et al. |
| 5,224,044 | A | 6/1993 | Tamura et al. |
| 5,295,393 | A | 3/1994 | Thiercelin |
| 5,333,692 | A | 8/1994 | Baugh et al. |
| 5,526,888 | A | 6/1996 | Gazewood |
| 5,845,712 | A | 12/1998 | Griffith |
| 5,921,318 | A | 7/1999 | Ross |
| 5,988,285 | A | 11/1999 | Tucker et al. |
| 6,006,838 | A | 12/1999 | Whiteley et al. |
| 6,059,032 | A | 5/2000 | Jones |
| 6,155,342 | A | 12/2000 | Oneal et al. |
| 6,155,350 | A | 12/2000 | Melenyzer et al. |
| 6,206,095 | B1 | 3/2001 | Baugh |
| 6,216,785 | B1 | 4/2001 | Achee, Jr. et al. |
| 6,220,356 | B1 | 4/2001 | Spikes |
| 6,302,199 | B1 | 10/2001 | Hawkins et al. |
| 6,334,486 | B1 | 1/2002 | Carmody et al. |
| 6,349,766 | B1 | 2/2002 | Bussear et al. |
| 6,371,208 | B1 | 4/2002 | Norman et al. |
| 6,443,228 | B1 | 9/2002 | Aronstam et al. |
| 6,543,538 | B2 | 4/2003 | Tolman et al. |
| 6,634,429 | B2 | 10/2003 | Henderson et al. |
| 6,907,936 | B2 | 6/2005 | Fehr et al. |
| 6,997,263 | B2 | 2/2006 | Campbell et al. |
| 7,036,582 | B2 | 5/2006 | Cook et al. |
| 7,066,265 | B2 | 6/2006 | Surjaatmadja |
| 7,093,664 | B2 | 8/2006 | Todd et al. |
| 7,096,954 | B2 | 8/2006 | Weng et al. |
| 7,108,067 | B2 | 9/2006 | Themig et al. |
| 7,114,559 | B2 | 10/2006 | Sonnier et al. |
| 7,128,146 | B2 | 10/2006 | Baugh et al. |
| 7,134,505 | B2 | 11/2006 | Fehr et al. |
| 7,168,494 | B2 | 1/2007 | Starr et al. |
| 7,210,533 | B2 | 5/2007 | Starr et al. |
| 7,322,417 | B2 | 1/2008 | Rytlewski et al. |
| 7,325,617 | B2 | 2/2008 | Murray |
| 7,350,582 | B2 | 4/2008 | McKeachnie et al. |
| 7,353,879 | B2 | 4/2008 | Todd et al. |
| 7,377,321 | B2 | 5/2008 | Rytlewski |
| 7,387,165 | B2 | 6/2008 | Lopez de Cardenas et al. |
| 7,431,091 | B2 | 10/2008 | Themig et al. |
| 7,464,764 | B2 | 12/2008 | Xu |
| 7,490,669 | B2 | 2/2009 | Walker et al. |
| 7,543,634 | B2 | 6/2009 | Fehr et al. |
| 7,543,647 | B2 | 6/2009 | Walker |
| 7,549,469 | B2 | 6/2009 | Garcia |
| 7,552,779 | B2 | 6/2009 | Murray |
| 7,571,765 | B2 | 8/2009 | Themig |
| 7,575,062 | B2 | 8/2009 | East, Jr. |
| 7,628,210 | B2 | 12/2009 | Avant et al. |
| 7,661,481 | B2 | 2/2010 | Todd et al. |
| 7,669,665 | B2 | 3/2010 | Millet et al. |
| 7,673,677 | B2 | 3/2010 | King et al. |
| 7,748,460 | B2 | 7/2010 | Themig et al. |
| 7,775,279 | B2 | 8/2010 | Marya et al. |
| 7,798,236 | B2 | 9/2010 | McKeachnie et al. |
| 7,832,472 | B2 | 11/2010 | Themig |
| 7,891,774 | B2 | 2/2011 | Silverbrook |
| 8,211,247 | B2 | 7/2012 | Marya et al. |
| 2003/0155118 | A1 | 8/2003 | Sonnier et al. |
| 2003/0180094 | A1 | 9/2003 | Madison |
| 2004/0020643 | A1 | 2/2004 | Thomeer et al. |
| 2004/0035586 | A1 | 2/2004 | Gudmestad et al. |
| 2004/0118564 | A1 | 6/2004 | Themig et al. |
| 2004/0163820 | A1 | 8/2004 | Bishop |
| 2004/0262016 | A1 | 12/2004 | Farquhar |
| 2006/0124310 | A1 | 6/2006 | Lopez de Cardenas et al. |
| 2006/0131031 | A1 | 6/2006 | McKeachnie et al. |
| 2006/0207764 | A1 | 9/2006 | Rytlewski |
| 2006/0243455 | A1 | 11/2006 | Telfer et al. |
| 2007/0044958 | A1 | 3/2007 | Rytlewski et al. |
| 2007/0107908 | A1 | 5/2007 | Vaidya et al. |
| 2007/0131413 | A1* | 6/2007 | Millet ..... E21B 33/1216 166/115 |
| 2007/0181224 | A1 | 8/2007 | Marya et al. |
| 2007/0181304 | A1 | 8/2007 | Rankin et al. |
| 2007/0272413 | A1 | 11/2007 | Rytlewski et al. |
| 2007/0284097 | A1 | 12/2007 | Swor et al. |
| 2008/0105438 | A1 | 5/2008 | Jordan et al. |
| 2008/0210429 | A1 | 9/2008 | McMillin et al. |
| 2009/0056934 | A1 | 3/2009 | Xu |
| 2009/0159289 | A1 | 6/2009 | Avant et al. |
| 2009/0178808 | A1 | 7/2009 | Williamson |
| 2010/0101803 | A1 | 4/2010 | Clayton et al. |
| 2010/0101806 | A1 | 4/2010 | Millet et al. |
| 2010/0132954 | A1 | 6/2010 | Telfer |
| 2010/0209288 | A1 | 8/2010 | Marya |
| 2010/0212886 | A1 | 8/2010 | Hall et al. |
| 2010/0252280 | A1 | 10/2010 | Swor et al. |
| 2010/0282469 | A1 | 11/2010 | Richard et al. |
| 2011/0056692 | A1 | 3/2011 | Lopez de Cardenas et al. |
| 2011/0127047 | A1 | 6/2011 | Themig et al. |
| 2011/0192607 | A1 | 8/2011 | Hofman et al. |
| 2011/0278010 | A1 | 11/2011 | Fehr et al. |
| 2011/0284232 | A1 | 11/2011 | Huang |
| 2012/0067583 | A1 | 3/2012 | Zimmerman et al. |
| 2012/0085538 | A1 | 4/2012 | Guerrero et al. |
| 2012/0145378 | A1 | 6/2012 | Frazier |
| 2012/0199341 | A1 | 8/2012 | Kellner et al. |
| 2012/0261115 | A1 | 10/2012 | Xu |
| 2012/0305236 | A1 | 12/2012 | Gouthaman |
| 2013/0062063 | A1 | 3/2013 | Baihly et al. |
| 2014/0014371 | A1 | 1/2014 | Jacob et al. |
| 2014/0216758 | A1 | 8/2014 | Jacob et al. |
| 2014/0216759 | A1 | 8/2014 | Jacob et al. |

FOREIGN PATENT DOCUMENTS

| | | | |
|---|---|---|---|
| WO | 2009023519 | A1 | 2/2009 |
| WO | 2011006173 | A2 | 1/2011 |
| WO | 2012174101 | A2 | 12/2012 |

OTHER PUBLICATIONS

Lonnes, S. B., Nygaard, K. J., Sorem, W. A., Hall, T. J., Tolman, R. C., Advanced Multizone Stimulation Technology, SPE 95778, Presented at the 2005 SPE Annual Technical Conference and Exhibition, Oct. 9-12, 2005, Dallas, TX, USA.

Rytlewski, G., Multiple-Layer Commpletions for Efficient Treatment of Multilayer Reservoirs, IADC/SPE 112476, Presented at the 2008 IADC/SPE Drilling Conference, Mar. 4-6, 2008, Orlando, FL, USA.

* cited by examiner

DEPLOYING AN EXPANDABLE DOWNHOLE SEAT ASSEMBLY

CROSS-REFERENCE TO RELATED PATENTS AND APPLICATIONS

This application claims priority to U.S. Provisional Patent Application No. 61/759,577, titled, "RADIALLY EXPANDING SOLID SEGMENTS TO FORM A SOLID RING"; U.S. Provisional Patent Application No. 61/759,584, titled, "SEGMENTED MULTI-LAYER RING WITH AN AXIAL ACTUATION"; U.S. Provisional Patent Application No. 61/759,592, titled, "METHOD AND APPARATUS FOR CREATING A FLUID BARRIER WITHIN A TUBING STRING"; and U.S. Provisional Patent Application No. 61/759,599, titled "MULTIPLE DISSOLUTION RATE ON CONTACTING DISSOLVING PARTS INSIDE A WELLBORE", each filed Feb. 1, 2013, and each incorporated herein by reference in their entirety and for all purposes.

This application is related to U.S. patent application Ser. No. 13/231,729, titled "COMPLETING A MULTISTAGE WELL", filed Sep. 3, 2011, and which is incorporated herein by reference. Additionally, this application is related to U.S. patent application Ser. No. 14/029,897, titled, "EXPANDABLE DOWNHOLE SEAT ASSEMBLY"; U.S. patent application Ser. No. 14/029,936, titled, "DEPLOYING AN EXPANDABLE DOWNHOLE SEAT ASSEMBLY"; and U.S. patent application Ser. No. 14/029,958, titled, "DOWNHOLE COMPONENT HAVING DISSOLVABLE COMPONENTS"; each filed Sep. 18, 2013, and incorporated herein by reference in their entirety and for all purposes.

BACKGROUND

A variety of different operations may be performed when preparing a well for production of oil or gas. Some operations may be implemented to help increase the productivity of the well and may include the actuation of one or more downhole tools. Additionally, some operations may be repeated in multiple zones of a well. For example, well stimulation operations may be performed to increase the permeability of the well in one or more zones. In some cases, a sleeve may be shifted to provide a pathway for fluid communication between an interior of a tubing string and a formation. The pathway may be used to fracture the formation or to extract oil or gas from the formation. Another well stimulation operation may include actuating a perforating gun to perforate a casing and a formation to create a pathway for fluid communication. These and other operations may be performed using various techniques, such as running a tool into the well on a conveyance mechanism to mechanically shift or inductively communicate with the tool to be actuated, pressurizing a control line, and so forth.

SUMMARY

The summary is provided to introduce a selection of concepts that are further described below in the detailed description. This summary is not intended to be used in limiting the scope of the claimed subject matter.

In an example implementation, a method includes running an assembly in a contracted state on a tool into a well. The assembly includes segments that are adapted to be radially contracted and arranged in a first number of layers along a longitudinal axis of the assembly. The technique includes using the tool to expand the assembly downhole in the well to transition the assembly between the contracted state and an expanded state. Using the tool to expand the seat assembly includes radially expanding the segments and longitudinally contracting the segments to arrange the layers in a second number of layers having at least one layer less than the first number.

In another example implementation, a tool that is useful with a well includes a mandrel and a rod. The mandrel includes a first set of surfaces that are adapted to contact segments of an assembly. The rod is adapted to travel relative to the mandrel and includes a second set of surfaces that are adapted to contact the segments of the assembly. The mandrel and rod are adapted to contact the segments with the first and second sets of surfaces to exert forces on the segments of the assembly in response to travel of the rod relative to the mandrel. The contact transitions the assembly between a contracted state in which the segments are radially contracted and an expanded state in which the segments are radially expanded and longitudinally contracted into a single axial layer.

In yet another example implementation, a system includes an assembly and a tool. The seat assembly is adapted to be configured in a contracted state in which segments of the assembly are radially contracted and arranged in a first number of layers along a longitudinal axis of the seat assembly. The seat assembly is also adapted to be configured in an expanded state in which the segments are radially expanded and longitudinally contracted in a second number layers having at least one fewer layers than the first number. The tool is adapted to mechanically engage the seat assembly to transition the seat assembly between the contracted and expanded states.

Advantages and other features will become apparent from the following drawing, description and claims.

BRIEF DESCRIPTION OF THE DRAWINGS

FIGS. 22H, 221, 22J and 22K are cross-sectional views of the setting tool and the segmented seat assembly illustrating use of the setting tool to expand a lower segment of the seat assembly to transition the seat assembly to the expanded state according to an example implementation.

DETAILED DESCRIPTION

Systems and techniques are disclosed herein to deploy and use a seat assembly. In some embodiments, the systems and techniques may be used in a well for purposes of performing a downhole operation. In this regard, the seat assembly that is disclosed herein may be run downhole in the well in a passageway of a tubing string that was previously installed in the well and secured to the tubing string at a desired location in which a downhole operation is to be performed. The tubing string may take the form of multiple pipes coupled together and lowered into a well. The downhole operation may be any of a number of operations (stimulation operations, perforating operations, and so forth) that rely on an object being landed in a seat of the seat assembly.

The seat assembly is an expandable, segmented assembly, which has two states: an unexpanded state and an expanded state. The unexpanded state has a smaller cross-section than the expanded state. The smaller cross-section allows running of the seat assembly downhole inside a tubing string. The expanded state forms a seat (e.g., a ring) that is constructed to catch an object deployed in the string. The seat and the object together may form a downhole fluid obstruction, or barrier. In accordance with example implementations, in its expanded state, the seat assembly is constructed to receive, or catch, an untethered object deployed in the tubing string. In this context, the "untethered object" refers to an object that is communicated downhole through the tubing string without the use of a conveyance line (a slickline, a wireline, a coiled tubing string and so forth) for at least a portion of its travel through the tubing string. As examples, the untethered object may take the form of a ball (or sphere), a dart or a bar.

The untethered object may, in accordance with example implementations, be deployed on the end of a tool string, which is conveyed into the well by wireline, slickline, coiled tubing, and so forth. Moreover, the untethered object may be, in accordance with example implementations, deployed on the end of a tool string, which includes a setting tool that deploys the segmented seat assembly. Thus, many variations are contemplated and the appended claims should be read broadly as possibly to include all such variations.

In accordance with example implementations, the seat assembly is a segmented apparatus that contains multiple curved sections that are constructed to radially contract and axially expand into multiple layers to form the contracted state. Additionally, the sections are constructed to radially expand and axially contract into a single layer to form a seat in the expanded state of the seat assembly to catch an object.

A setting tool may be used to contact the sections of the seat assembly for purposes of transitioning the seat assembly between the expanded and contracted states, as further described herein.

Figure 1:
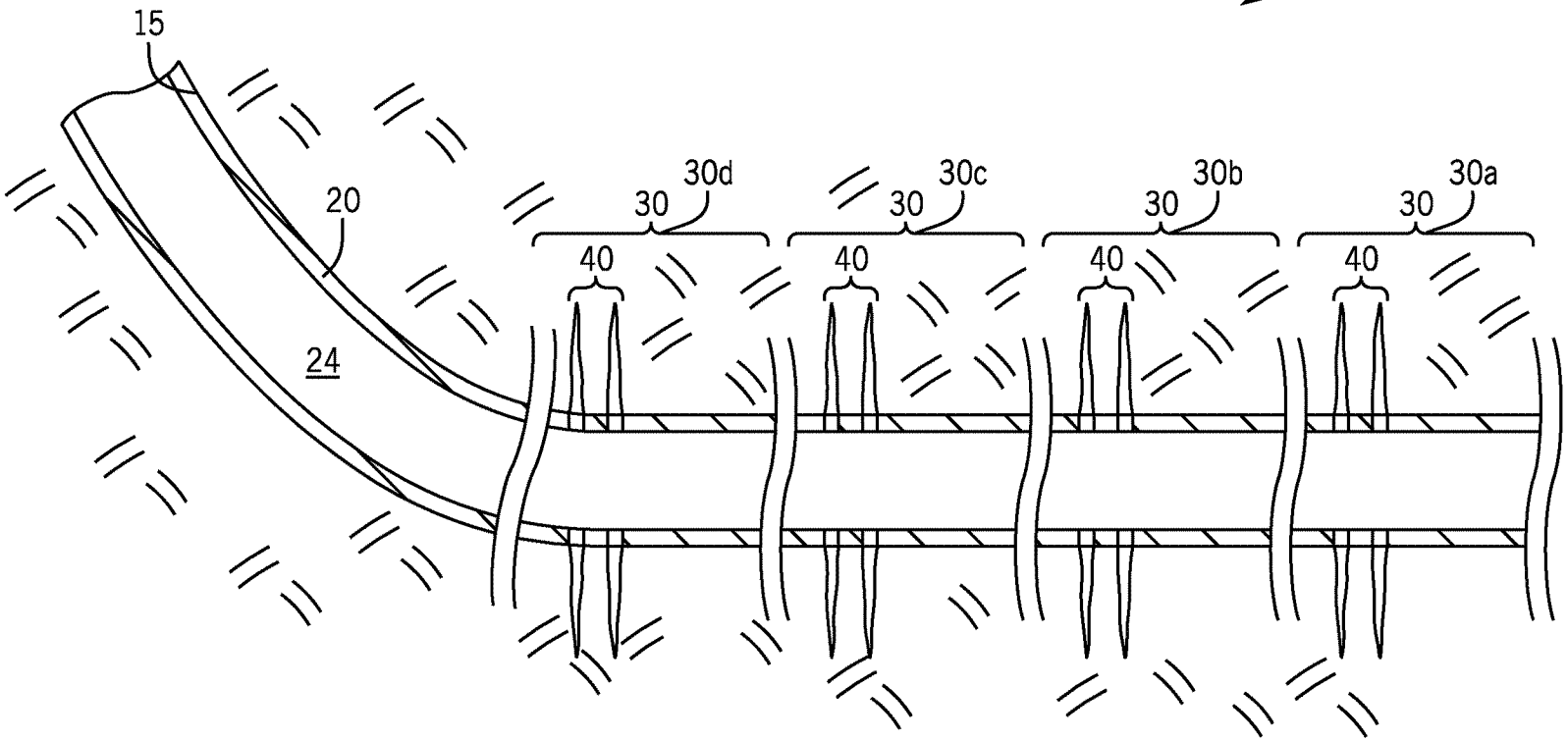
FIG. 1 is a schematic diagram of a well according to an example implementation.

In accordance with some implementations, a well 10 includes a wellbore 15. The wellbore 15 may traverse one or more hydrocarbon-bearing formations. As an example, a tubing string 20, as depicted in FIG. 1, can be positioned in the wellbore 15. The tubing string 20 may be cemented to the wellbore 15 (such wellbores are typically referred to as "cased hole" wellbores); or the tubing string 20 may be secured to the surrounding formation(s) by packers (such wellbores typically are referred to as "open hole" wellbores). In general, the wellbore 15 may extend through multiple zones, or stages 30 (four example stages 30*a*, 30*b*, 30*c* and 30*d*, being depicted in FIG. 1, as examples), of the well 10.

It is noted that although FIG. 1 and other figures disclosed herein depict a lateral wellbore, the techniques and systems that are disclosed herein may likewise be applied to vertical wellbores. Moreover, in accordance with some implementations, the well 10 may contain multiple wellbores, which contain tubing strings that are similar to the illustrated tubing string 20 of FIG. 1. The well 10 may be a subsea well or may be a terrestrial well, depending on the particular implementations. Additionally, the well 10 may be an injection well or may be a production well. Thus, many implementations are contemplated, which are within the scope of the appended claims.

Downhole operations may be performed in the stages 30 in a particular directional order, in accordance with example implementations. For example, downhole operations may be conducted in a direction from a toe end of the wellbore to a heel end of the wellbore 15, in accordance with some implementations. In further implementations, these downhole operations may be connected from the heel end to the toe end (e.g., terminal end) of the wellbore 15. In accordance with further example implementations, the operations may be performed in no particular order, or sequence.

FIG. 1 depicts that fluid communication with the surrounding hydrocarbon formation(s) has been enhanced through sets 40 of perforation tunnels that, for this example, are formed in each stage 30 and extend through the tubing string 20. It is noted that each stage 30 may have multiple sets of such perforation tunnels 40. Although perforation tunnels 40 are depicted in FIG. 1, it is understood that other techniques may be used to establish/enhance fluid communication with the surrounding formation (s), as the fluid communication may be established using, for example, a jetting tool that communicates an abrasive slurry to perforate the tubing string wall; opening sleeve valves of the tubing string 20; and so forth.

Figure 2:
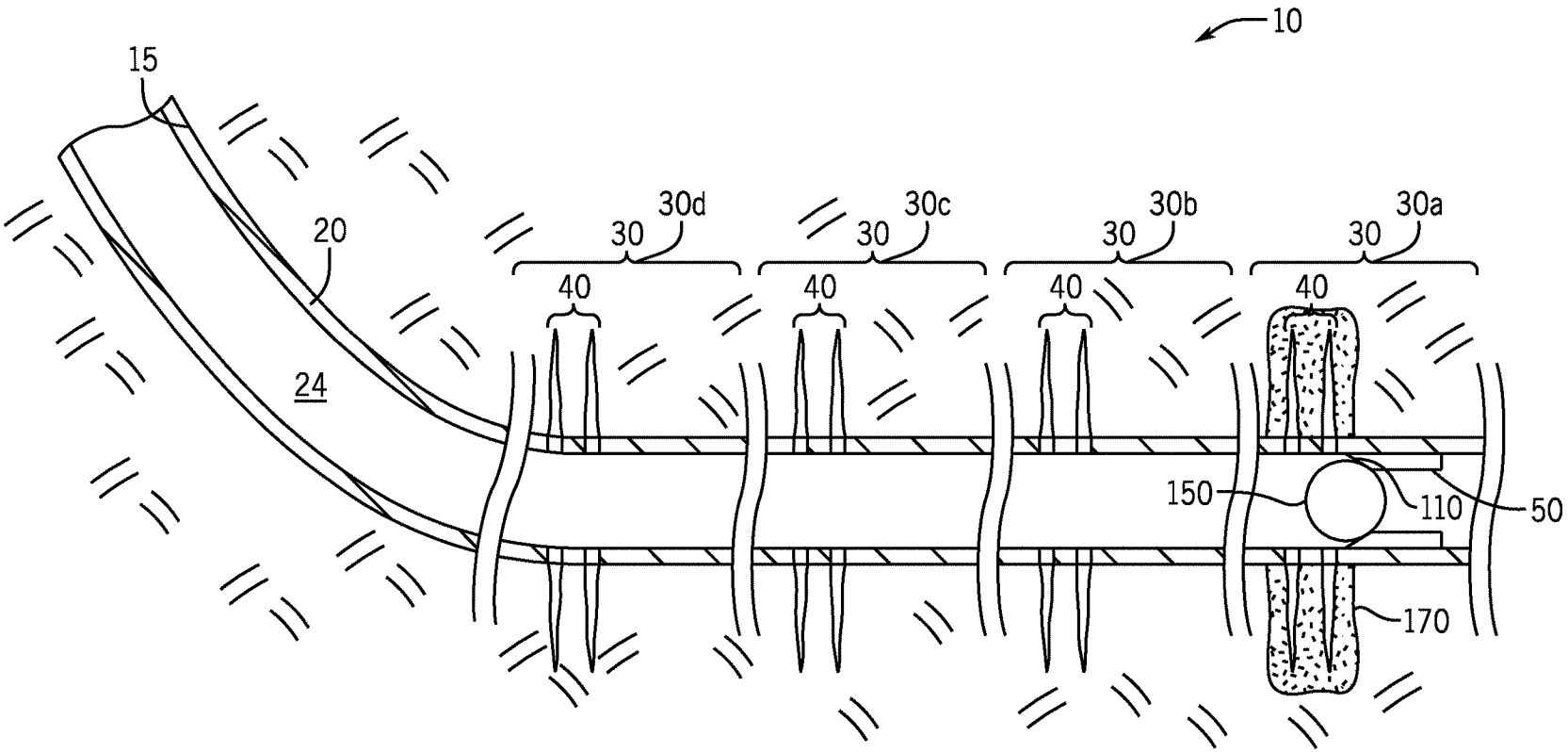
FIG. 2 illustrates a stimulation operation in a stage of the well of FIG. 1 according to an example implementation.

Referring to FIG. 2 in conjunction with FIG. 1, as an example, a stimulation operation may be performed in the stage 30*a* by deploying an expandable, segmented seat assembly 50 (herein called the "seat assembly") into the tubing string 20 on a setting tool (as further disclosed herein) in a contracted state of the assembly 50. In the contracted state, the assembly 50 has an outer diameter to allow it to be run-in-hole. The seat assembly 50 is expanded downhole in the well. In its expanded state, the seat assembly 50 has a larger outer diameter than in its contracted state. Additionally, the seat assembly 50 is shorter longitudinally in the expanded stated than the contracted state. In the expanded state, the seat assembly 50 engages, and is secured on, an inner surface of the tubing string 20 at a targeted location in the stage 30*a*. For the example implementation depicted in FIG. 2, the seat assembly 50 is secured in the tubing string 20 near the bottom, or downhole end, of the stage 30*a*. Once secured inside the tubing string 20, the combination of the seat assembly 50 and an untethered object (here, an activation ball 150) form a fluid tight obstruction, or barrier, to divert fluid in the tubing string 20 uphole of the barrier. That is, fluid is unable to pass from uphole of the seat assembly 50 and activation ball 150 to downhole of the seat assembly and activation ball. Thus, for the example implementation of FIG. 2, the fluid barrier may be used to direct fracture fluid (e.g., fracture fluid pumped into the tubing string 20 from the Earth surface) into the stage 30*a*.

Figure 3A:
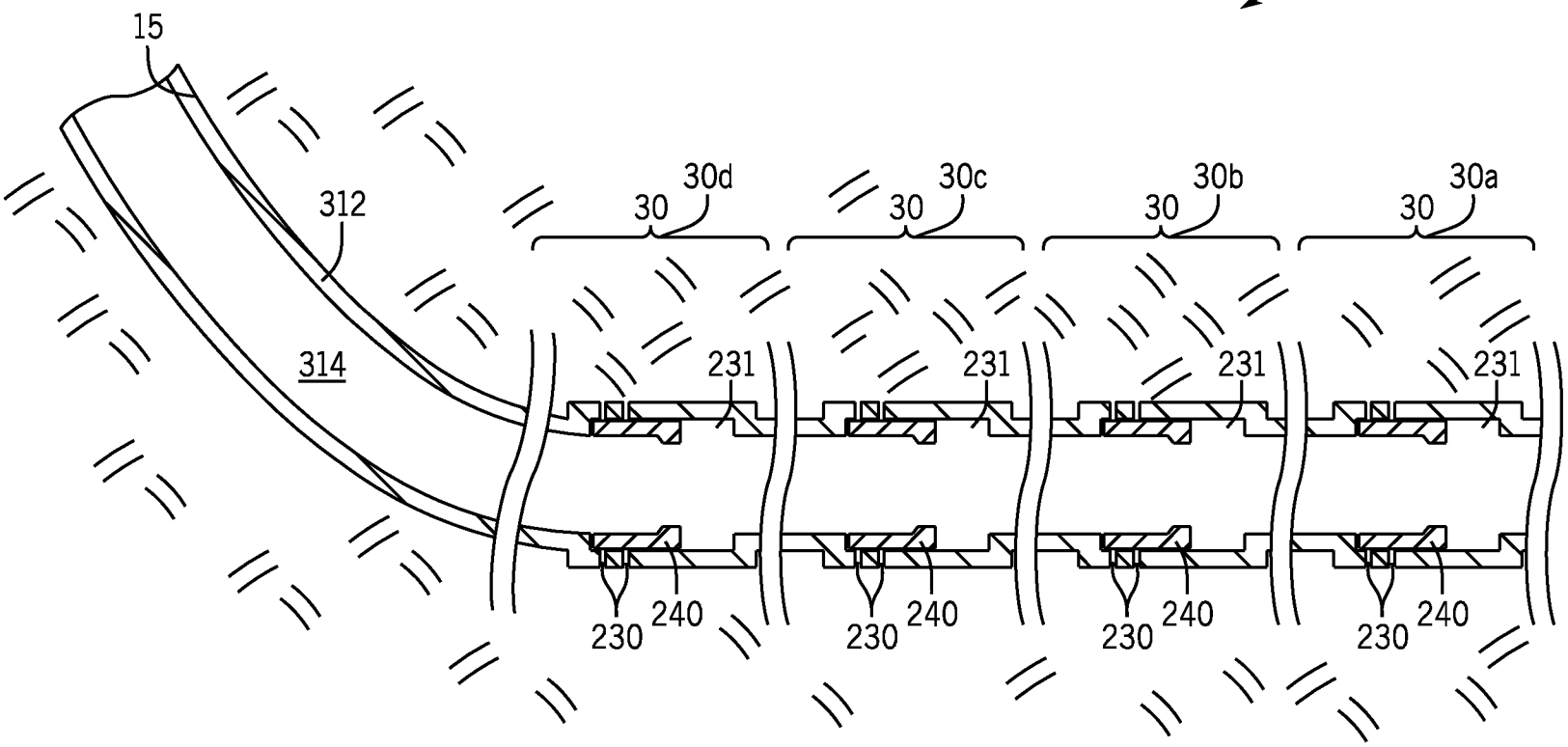
FIG. 3A is a schematic diagram of a well illustrating multiple stages with sleeves according to an example implementation.

FIG. 3A depicts an example tubing string 312 of a well 300, which has a central passageway 314 and extends through associated stages 30*a*, 30*b*, 30*c* and 30*d* of the well 300. Each stage 30 has an associated sleeve 240, which resides in a recess 231 of the tubing string 312. The sleeve 240 may have been previously positioned in the stage 30. For the state of the well 300 depicted in FIG. 3A, the sleeve 240 is positioned in the well in a closed state and therefore covers radial ports 230 in the tubing string wall. As an example, each stage 30 may be associated with a given set of radial ports 230, so that by communicating an untethered object downhole inside the passageway 314 of the tubing string 312 and landing the ball in a seat of a seat assembly 237 (see FIG. 3B), a corresponding fluid barrier may be formed to divert fluid through the associate set of radial ports 230.

Figure 3B:
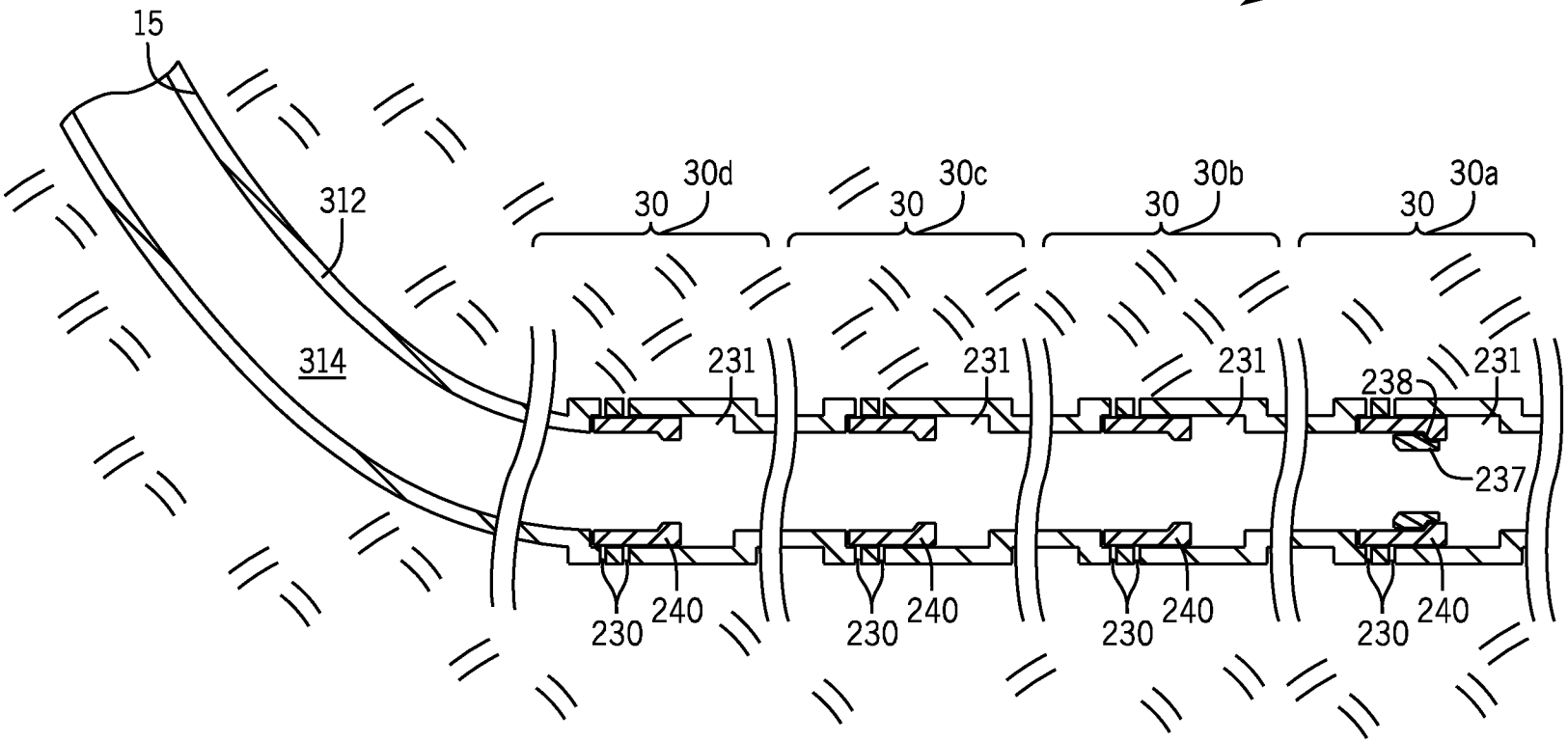
FIG. 3B illustrates a seat assembly installed in a stage of the well of FIG. 3A according to an example implementation.

Referring to FIG. 3B, as shown, the seat assembly 237 has been deployed (attached, anchored, swaged) to the sleeve 240. A shoulder 238 on the sleeve 240 which engages a corresponding shoulder of the seat assembly 237 may be provided to connect the seat assembly 237 and the sleeve 240. Other connection methods may be used, such as recess on the sleeve 240, a direct anchoring with the seat assembly 237, and so forth.

It is noted that the seat assemblies 237 may be installed one by one after the stimulation of each stage 30 (as discussed further below); or multiple seat assemblies 237 may be installed in a single trip into the well 300. Therefore, the seat, or inner catching diameter of the seat assembly 237, for the different assemblies 237, may have different dimensions, such as inner dimensions that are relatively smaller downhole and progressively become larger moving in an uphole direction (e.g., towards surface). This can permit the use of differently-sized untethered objects to land on the seat assemblies 237 without further downhole intervention. Thus, continuous pumping treatment of multiple stages 30 may be achieved.

Figure 3C:
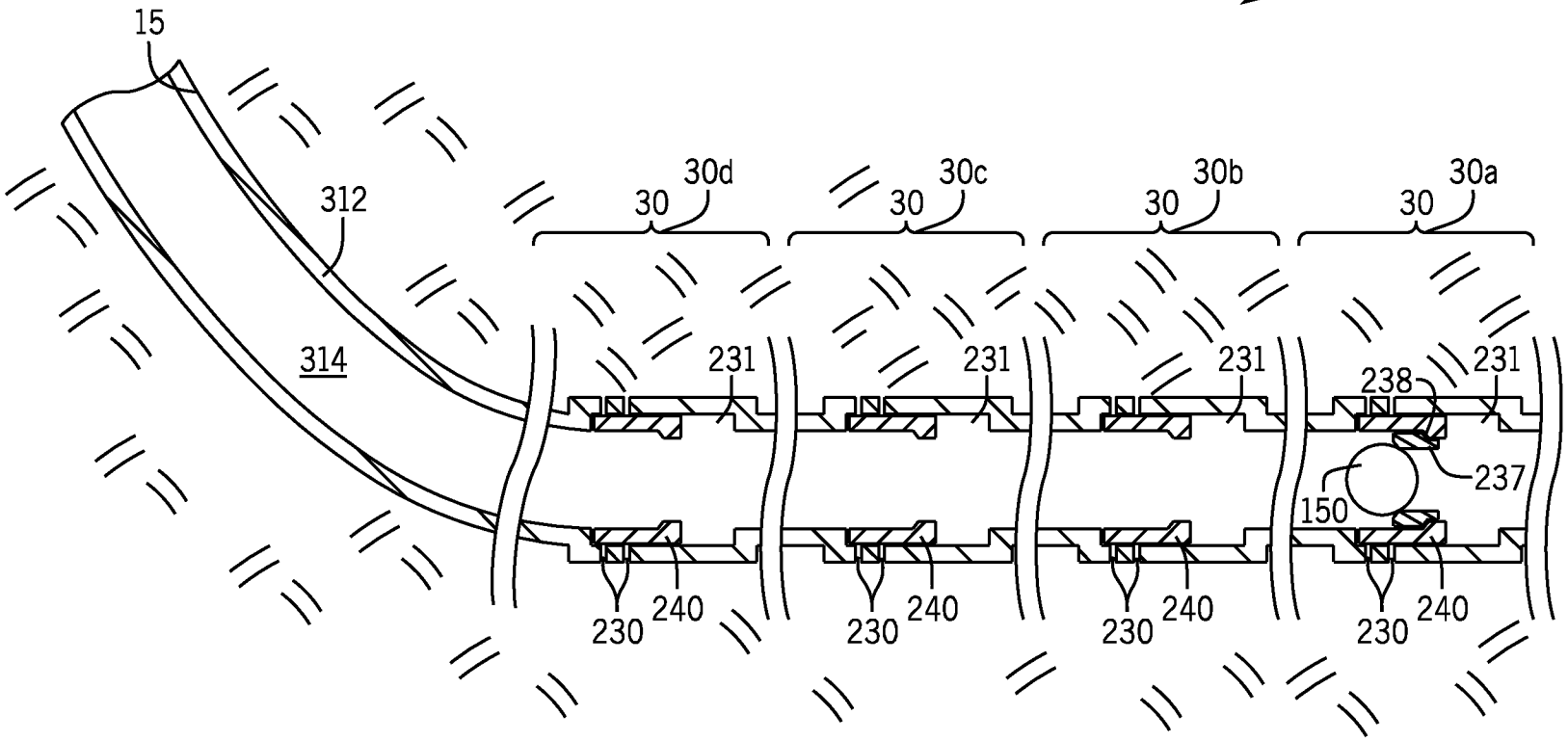
FIG. 3C illustrates an untethered object landing on the seat assembly of FIG. 3B according to an example implementation.

Referring to FIG. 3C, this figure depicts the landing of the untethered object 150 on the seat assembly 237 of the stage 30*a*. At this point, the untethered object 150 has been caught by the seat assembly 237.

Figure 3D:
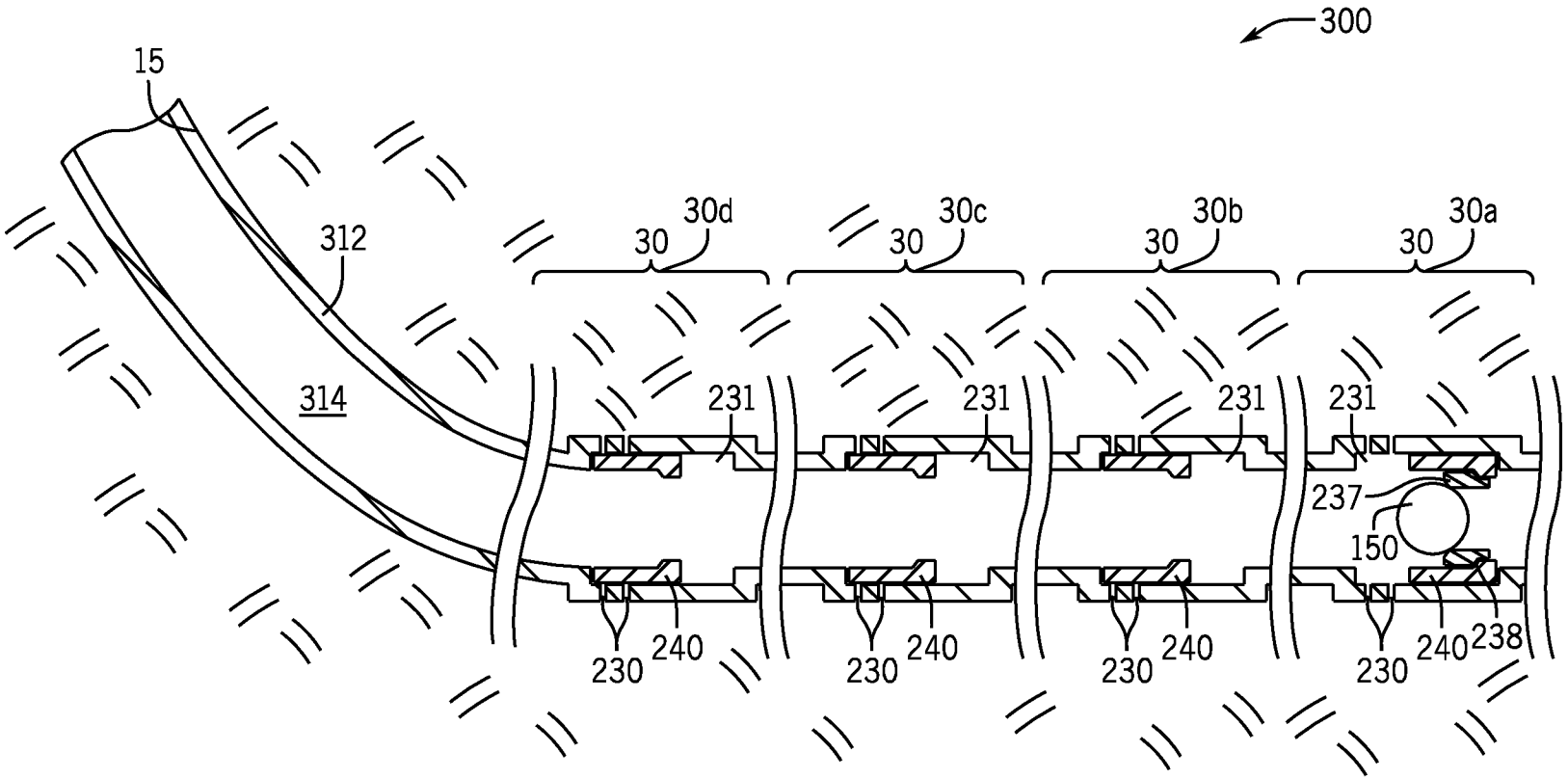
FIG. 3D illustrates a sleeve in a stage of the well shifted by the untethered object of FIG. 3C according to an example implementation.

Referring to FIG. 3D, due to the force that is exerted by the untethered object 150, due to, for example, either the momentum of the untethered object 150 or the pressure differential created by the untethered object, the sleeve 240 and the seat assembly 237 can be shifted downhole, revealing the radial ports 230. In this position, a pumping treatment (the pumping of a fracturing fluid, for example) may be performed in the stage 30*a*.

Figure 3E:
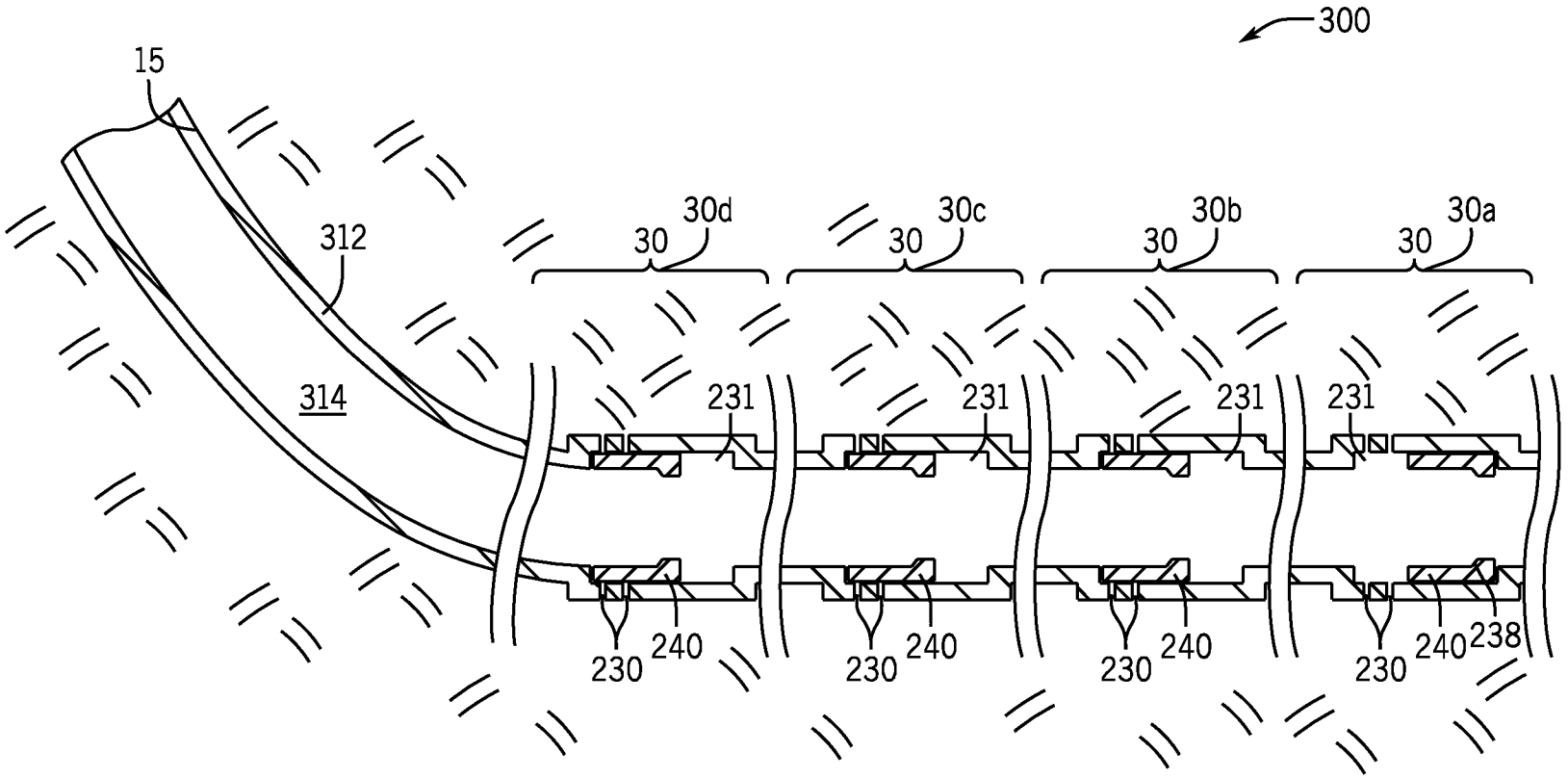
FIG. 3E illustrates the shifted sleeve of FIG. 3D with the untethered object dissolved according to an example implementation.

FIG. 3E depicts the stage 30*a* with the sleeve 240 in the opened position and with the seat assembly 237 and untethered object 150 being dissolved, as further discussed below.

Figure 4:
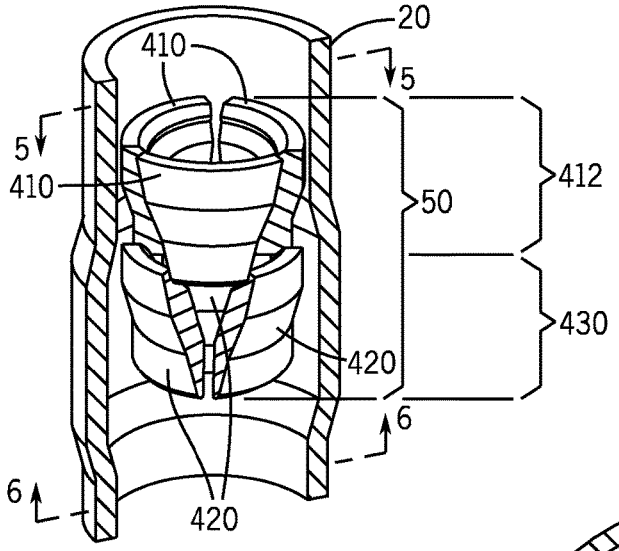
FIG. 4 is a schematic view illustrating an expandable, segmented seat assembly in a contracted state and inside a tubing string according to an example implementation.
Figure 5:
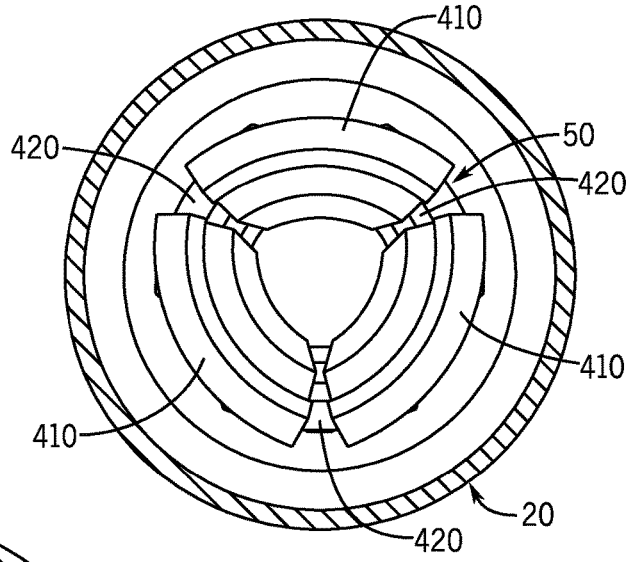
FIG. 5 is a cross-sectional view taken along line 5-5 of FIG. 4 according to an example implementation.
Figure 6:
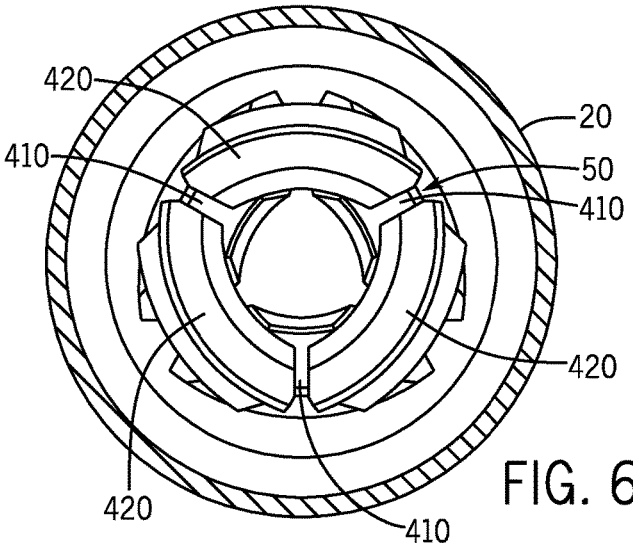
FIG. 6 is a cross-sectional view taken along line 6-6 of FIG. 4 according to an example implementation.

As an example, FIG. 4 is a perspective of the seat assembly 50, and FIGS. 5 and 6 illustrate cross-sectional views of the seat assembly 50 of FIG. 4, in accordance with an example implementation. Referring to FIG. 4, this figure depicts the seat assembly 50 in a contracted state, i.e., in a radially collapsed state having a smaller outer diameter, which facilitates travel of the seat assembly 50 downhole to its final position. The seat assembly, 50 for this example implementation, has two sets of arcuate segments: three upper segments 410; and three lower segments 420. In the contracted state, the segments 410 and 420 are radially contracted and are longitudinally, or axially, expanded into two layers 412 and 430.

Figure 7:
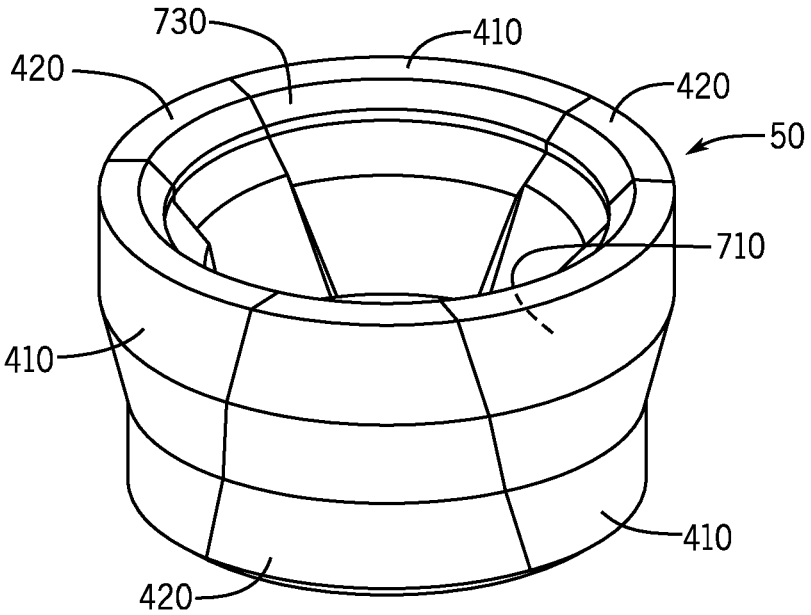
FIG. 7 is a perspective view of the seat assembly in an expanded state according to an example implementation.

The upper segment 410 can have a curved wedge that has a radius of curvature about the longitudinal axis of the seat assembly 50 and can be larger at its top end than at its bottom end. The lower segment 420 can have an arcuate wedge that has a radius of curvature about the longitudinal axis (as the upper segment 410) and can be larger at its bottom end than at its top end. Due to the relative complementary profiles of the segments 410 and 420, when the seat assembly 50 expands (i.e., when the segments 410 and 420 radially expand and the segments 410 and 420 axially contract), the two layers 412 and 430 longitudinally, or axially, compress into a single layer of segments such that each upper segment 410 is complimentarily received between two lower segments 420, and vice versa, as depicted in FIG. 7. In its expanded state, the seat assembly 50 forms a tubular member having a seat that is sized to catch an untethered object deployed in the tubing string 20.

Figure 8:
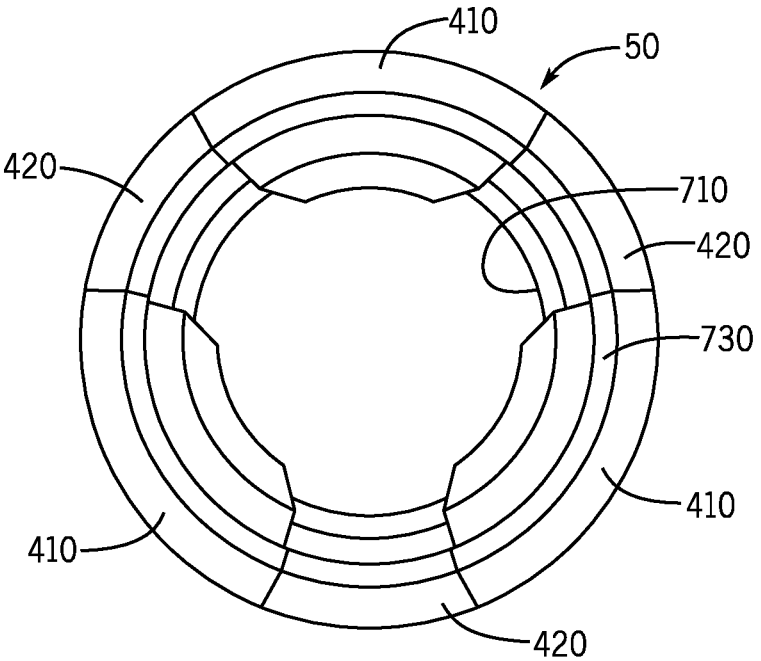
FIG. 8 is a top view of the seat assembly of FIG. 7 according to an example implementation.

An upper curved surface of each of the segments 410 and 420 can form a corresponding section of a seat ring 730 (i.e., the "seat") of the seat assembly 50 when the assembly 50 is in its expanded state. As depicted in FIG. 8, in its expanded state, the seat ring 730 of the seat assembly 50 defines an opening 710 sized to control the size of objects that pass through the seat ring 730 and the size of objects the seat ring 730 catches.

Figure 9:
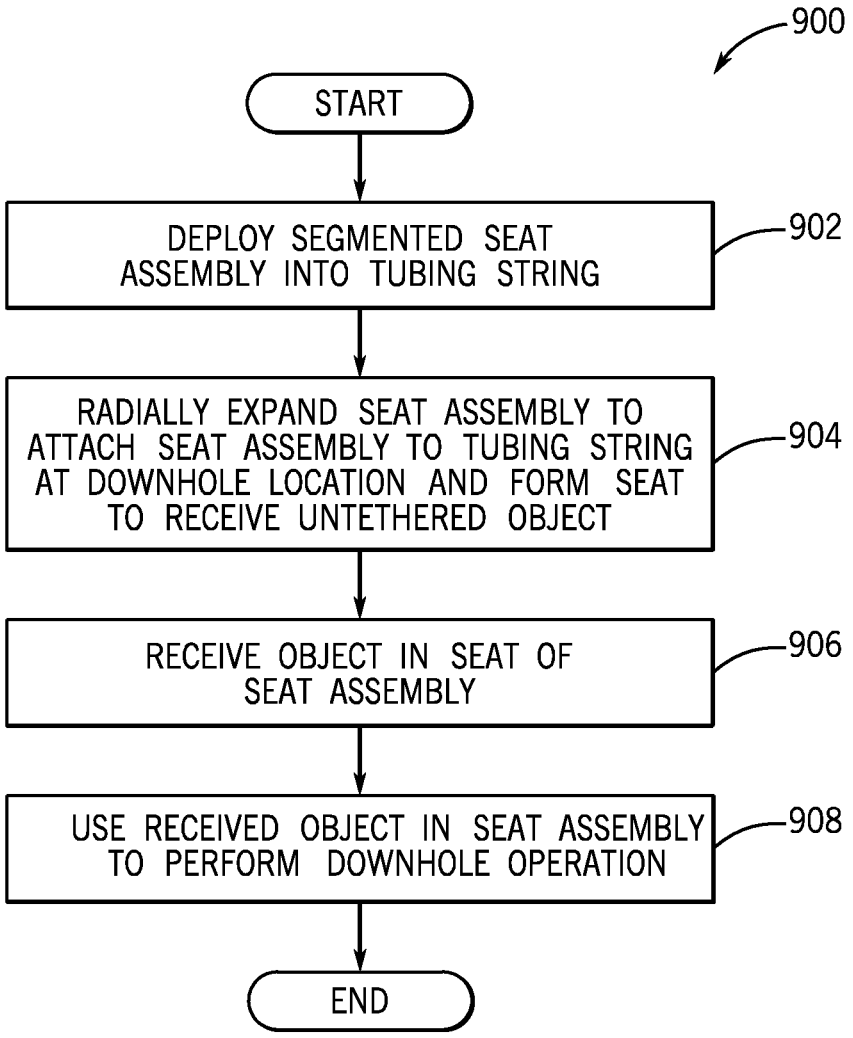
FIG. 9 is a flow diagram depicting a technique to deploy and use an expandable seat assembly according to an example implementation.

Thus, referring to FIG. 9, in accordance with example, implementations, a technique 900 includes deploying (block 902) a segmented seat assembly into a tubing string and radially expanding (block 904) the seat assembly to attach the seat assembly to a tubing string at a downhole location and form a seat to receive an untethered object. Pursuant to the technique 900, a seat of the seat assembly catches an object and is used to perform a downhole operation (block 908).

Figure 10:
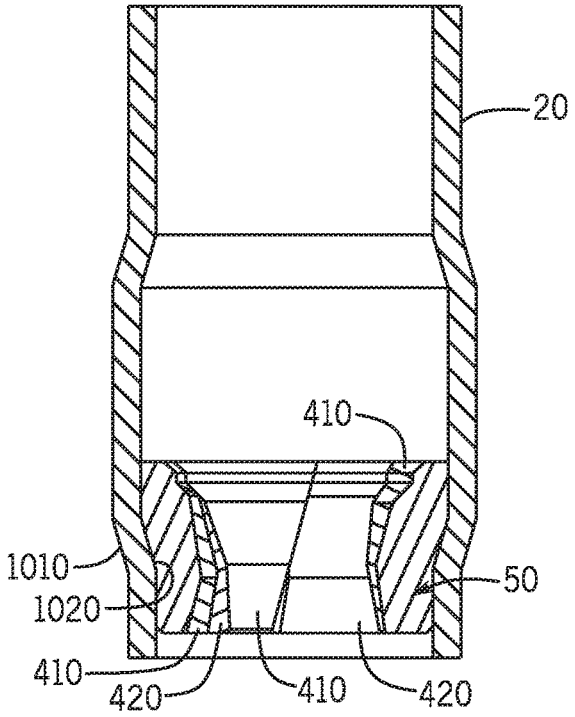
FIG. 10 is a cross-sectional view of the seat assembly in an expanded state inside a tubing string according to an example implementation.

The seat assembly 50 may attach to the tubing string in numerous different ways, depending on the particular implementation. For example, FIG. 10 depicts an example tubing string 20 that contains a narrowed seat profile 1020, which complements an outer profile of the seat assembly 50 in its expanded state. In this regard, as depicted in FIG. 10, the segments 410 and 420 contain corresponding outer profiles 1010 that engage the tubing profile 1010 to catch the seat assembly 50 on the profile 1020. In accordance with example implementations, at the seat profile 1020, the tubing string 50 has a sufficiently small cross-section, or diameter for purposes of forming frictional contact to allow a setting tool to transition the seat assembly 50 to the expanded state, as further disclosed herein.

Figure 11:
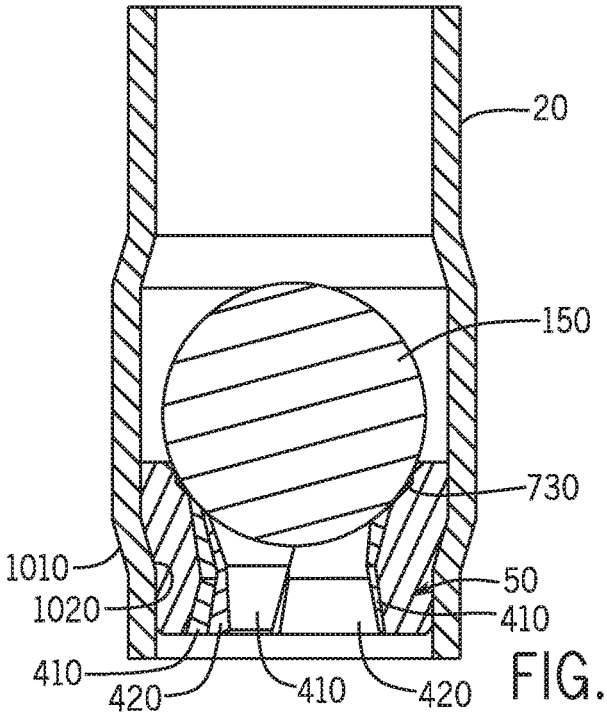
FIG. 11 is a cross-sectional view of the seat assembly in an expanded state inside a tubing string and in receipt of an activation ball according to an example implementation.

Moreover, in accordance with example implementations, the full radial expansion and actual contraction of the seat assembly 50 may be enhanced by the reception of the untethered object 150. As shown in FIG. 11, the untethered object 150 has a diameter that is sized to land in the seat ring 730 and further expands the seat assembly 50.

Further systems and techniques to run the seat assembly 50 downhole and secure the seat assembly 50 in place downhole are further discussed below.

Figure 12:
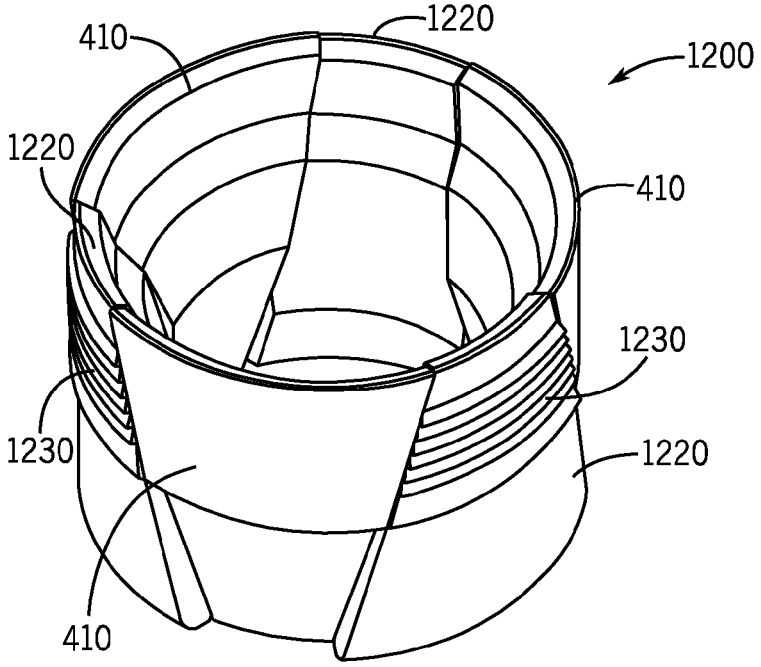
FIGS. 12 and 13 are perspective views of expandable seat assemblies according to further example implementations.
Figure 13:
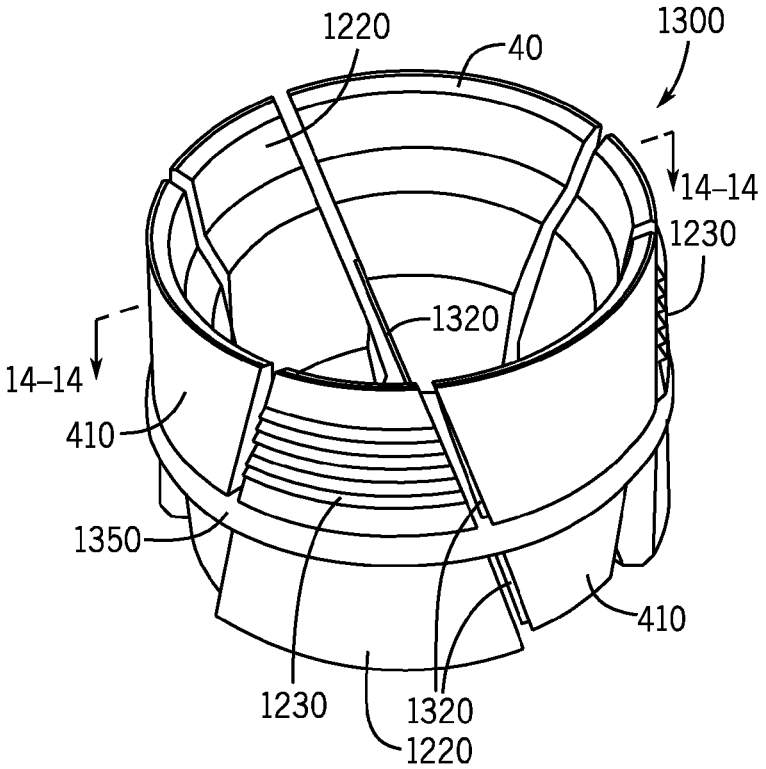

Other implementations are contemplated. For example, FIG. 12 depicts a seat assembly 1200 that has similar elements to the seat assembly 50, with similar reference numerals being used to depict similar elements. The seat assembly 1200 has segments 1220 that replace the segments 420. The segments 1220 can be arcuate and wedge-shaped sections similar to the segments 420. However, unlike the segments 420, the segments 1220 have anchors, or slips 1230, that are disposed on the outer surface of the segments 1220 for purposes of securing or anchoring the seat assembly 1200 to the tubing string wall when the segments 1220 radially expand. As another example, FIG. 13 depicts a seat assembly 1300 that that has similar elements to the seat assembly 1200, with similar reference numerals being used to depict similar elements.

Figure 14:
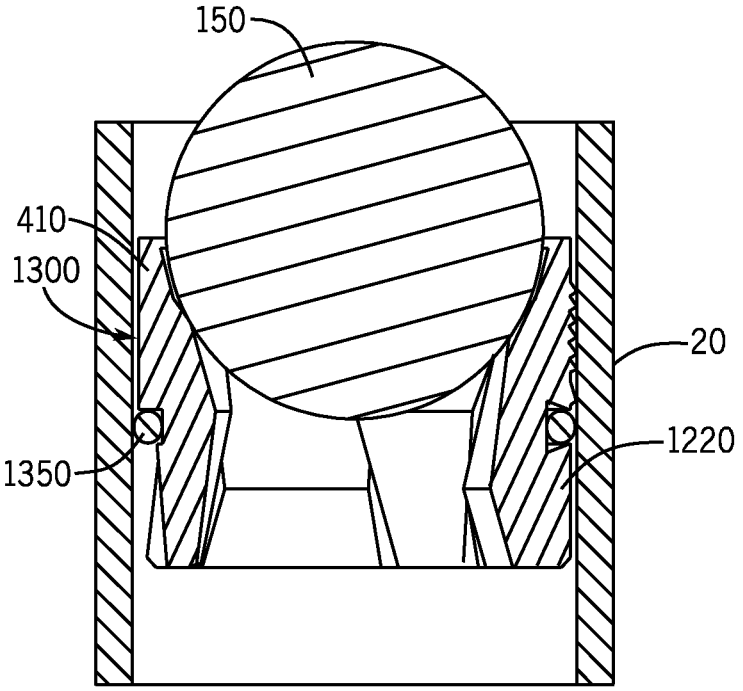
FIG. 14 is a cross-sectional view of the seat assembly taken along line 14-14 of FIG. 13 when the seat assembly is in receipt of an activation ball according to an example implementation.

The seat assembly 1300 can contain fluid seals. In this manner, in accordance with example implementations, the seat assembly 1300 has fluid seals 1320 that are disposed between the axially extending edges of the segments 410 and 1220. The fluid seals 1320 help to create a fluid seal when an object lands on the seat assembly 1300. Moreover, the seat assembly 1300 includes a peripherally extending seal element 1350 (an o-ring, for example), which extends about the periphery of the segments 410 and 1220 to form a fluid seal between the outer surface of the expanded seat assembly 1300 and the inner surface of the tubing string wall. FIG. 14 depicts a cross-sectional view of the seat assembly 1300 of FIG. 13 in the radially expanded state when receiving an untethered object 150.

The collective outer profile of the segments 410 and 420 may be contoured in a manner to form an object that engages a seat assembly that is disposed further downhole. In this manner, after the seat assembly 1300 performs its intended function by catching the untethered object, the seat assembly may then be transitioned (via a downhole tool, for example) into its radially contracted state so that the seat assembly (or a portion thereof) may travel further downhole and serve as an untethered object to perform another downhole operation.

Figure 27:
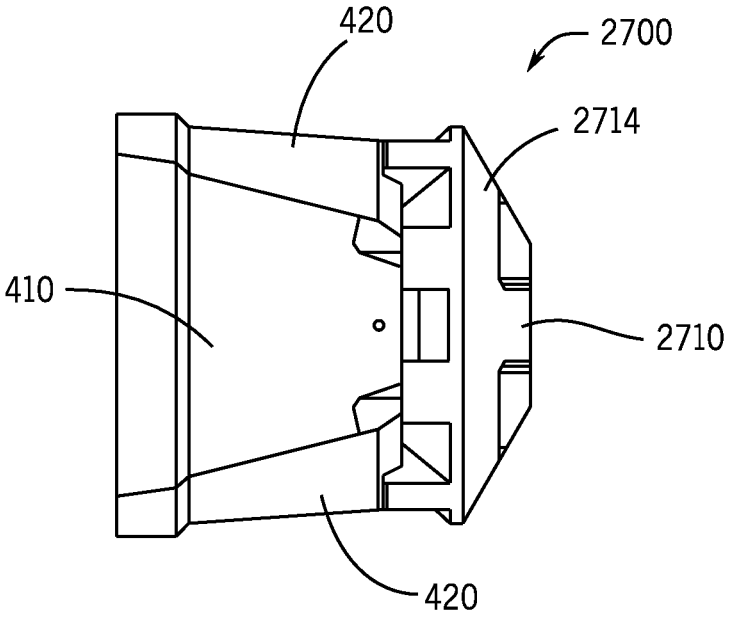
FIG. 27 is a perspective view of a seat assembly according to an example implementation.

A segmented seat assembly 2700 of FIG. 27 may be used having upper seat segments 410 and lower seat segments 420 similar to the seat segments discussed above. The segmented seat assembly 2700 includes a lower contoured cap 2710, which is profiled. For example, the lower contoured cap 2710 may include beveled features, as depicted at reference number 2714. The lower contoured cap 2710 may form a contoured profile to engage a seat that is positioned below the segmented seat assembly 2700 after the segmented seat assembly 2700 is released. As an example, in accordance with some implementations, the cap 2710 may be attached to the lower seat segments 420.

Figure 15:
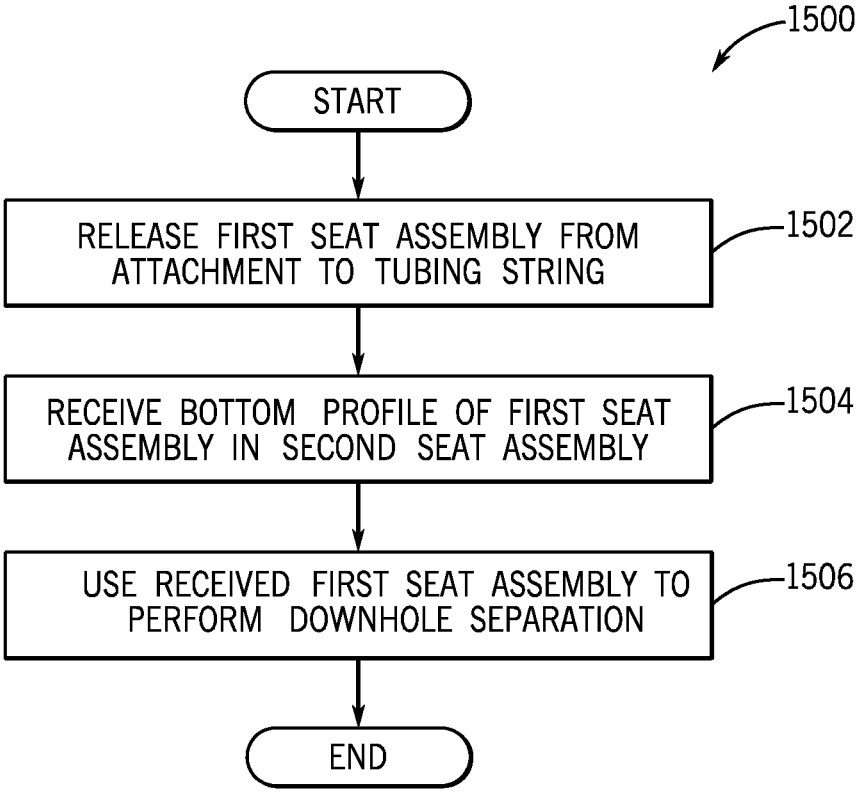
FIG. 15 is a flow diagram depicting a technique to deploy and use an expandable seat assembly according to a further example implementation.

Referring to FIG. 15, in accordance with an example implementation, a technique 1500 includes releasing (block 1502) a first seat assembly from being attached to a tubing string and receiving (block 1504) a bottom profile of the first seat assembly in a second seat assembly. Pursuant to the technique 1500, the received first seat assembly may then be used to perform a downhole operation (block 1506).

Figure 16A:
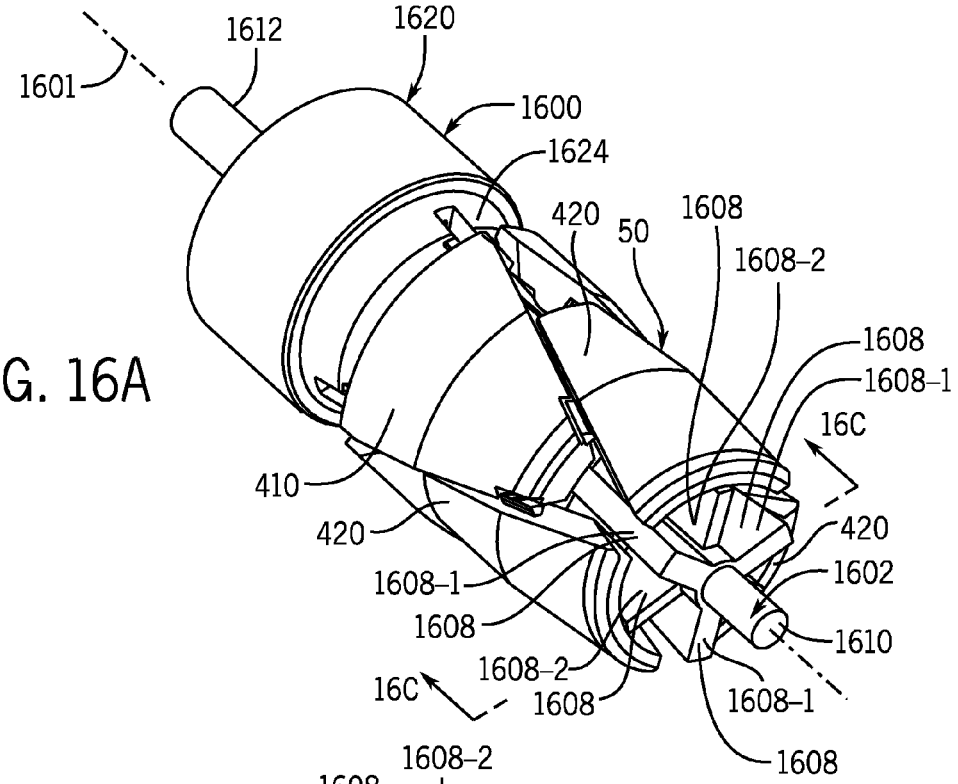
FIG. 16A is a perspective view of a seat assembly setting tool and a segmented seat assembly according to an example implementation.

Referring to FIG. 16A, in accordance with an example implementation, a setting tool 1600 may be used to transition the seat assembly 50 between its contracted and expanded states. As further disclosed herein, the setting tool 1600 includes components that move relative to each other to expand or contract the seat assembly 50: a rod 1602 and a mandrel 1620 which generally circumscribes the rod 1602. The relative motion between the rod 1602 and the mandrel 1620 causes surfaces of the mandrel 1620 and rod 1602 to contact the upper 410 and lower 420 segments of the seat assembly 50 to radially expand the segments 410 and 420 and longitudinally contract the segments into a single layer to form the seat, as described above.

As depicted in FIG. 16A, the rod 1602 and mandrel 1620 may be generally concentric with a longitudinal axis 1601 and extend along the longitudinal axis 1601. An upper end 1612 of the rod 1602 may be attached to a conveyance line (a coiled tubing string, for example). A bottom end 1610 of the rod 1602 may be free or attached to a downhole tool or string, depending on the particular implementation.

Figure 16B:
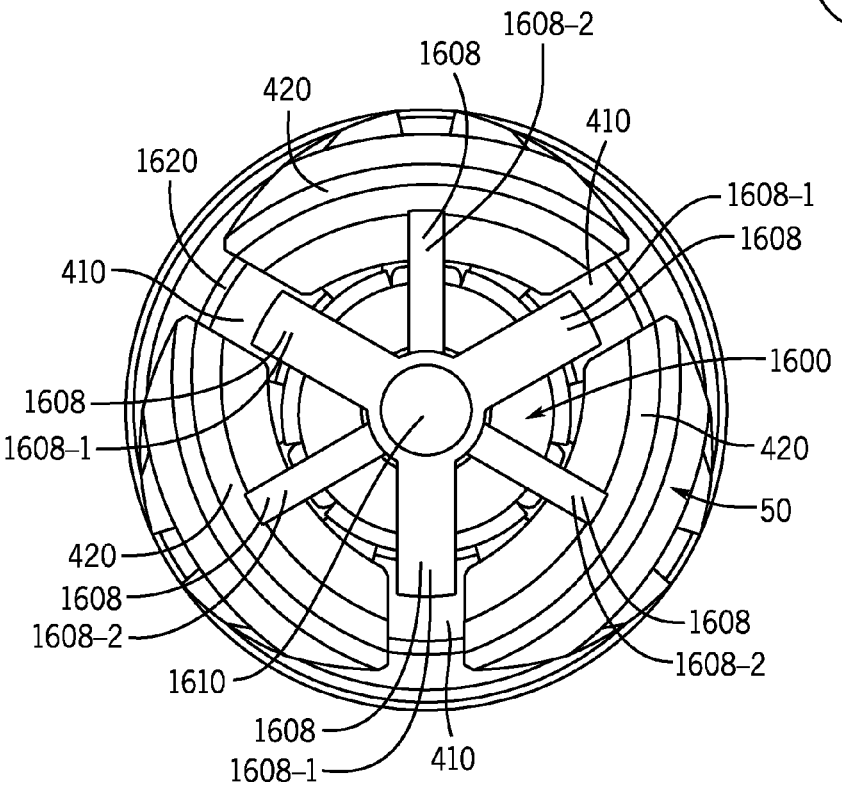
FIG. 16B is a bottom view of the seat assembly setting tool and seat assembly of FIG. 16A according to an example implementation.

Referring to FIG. 16B in conjunction with FIG. 16A, in accordance with example implementations, the rod 1602 contains radially extending vanes 1608 for purposes of contacting inner surfaces of the seat assembly segments 410 and 420: vanes 1608-1 to contact the upper segments 410; and vanes 1608-2 to contact the lower segments 420. For the specific example implementation that is illustrated in FIGS. 16A and 16B, the setting tool 1600 includes six vanes 1608, i.e., three vanes 1608-1 contacting for the upper segments 410 and three vanes 1608-2 for contacting the lower segments 420. Moreover, as shown, the vanes 1608 may be equally distributed around the longitudinal axis 1601 of the setting tool 1600, in accordance with example implementations. Although the examples depicted herein show two layers of three segments, the possibility of many combinations with additional layers or with a different number of segments per layer may be used (combinations of anywhere from 2 to 20 for the layers and segments, as examples) are contemplated and are within the scope of the appended claims.

Figure 16C:
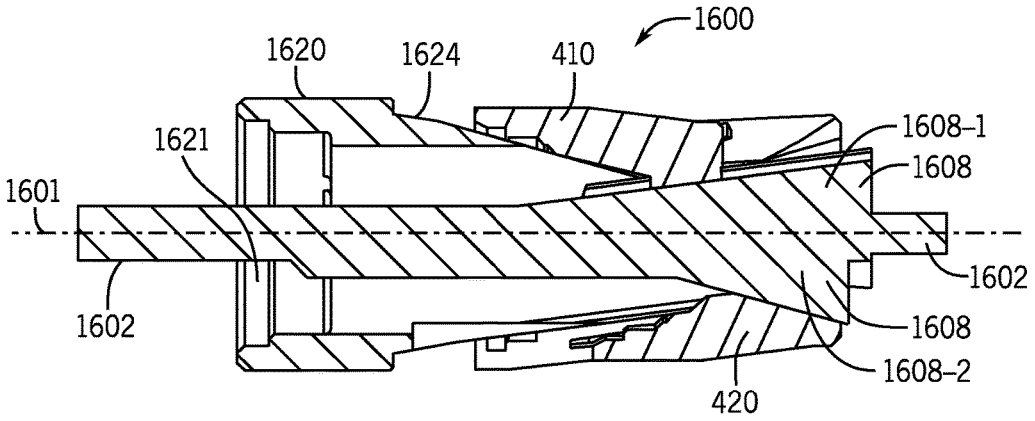
FIG. 16C is a cross-sectional view taken along line 16C-16C of FIG. 16A according to an example implementation.

Referring to FIG. 16C, relative motion of the rod 1602 relative to the mandrel 1620 longitudinally compresses the segments 410 and 420 along the longitudinal axis 1601, as well as radially expands the segments 410 and 420. This occurs due to the contact between the segments 410 and 420 with the inclined faces of the vanes 1608, such as the illustrated incline faces of the vanes 1608-1 and 1608-2 contacting inner surfaces of the segments 410 and 420, as depicted in FIG. 16C.

Figure 17:
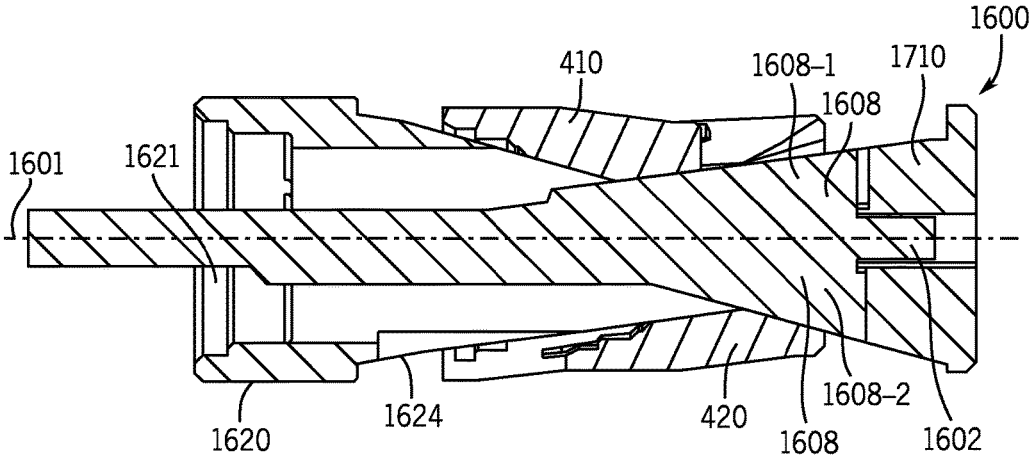
FIG. 17 is a cross-sectional view of a seat assembly setting tool and a segmented seat assembly according to a further example implementation.

FIG. 17 depicts a cross-sectional view for the seat assembly setting tool 1600 according to a further implementation. In general, for this implementation, the setting tool 1600 includes a bottom compression member 1710 that is disposed at the lower end of the rod 1602. As further disclosed below, the compression member 1710 aids in exerting a radial setting force on the segments 410 and 420 and may be released from the setting tool 1600 and left downhole with the expanded seat assembly (after the remainder of the setting tool 1600 is retrieved from the well) to form a retaining device for the seat assembly, as further discussed below.

Figure 18A:
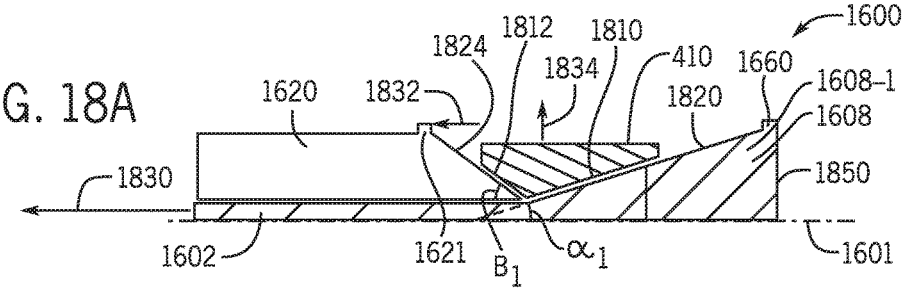
FIGS. 18A, 18B, 18C, 18D, 18E and 18F are cross-sectional views illustrating use of the setting tool to expand an upper segment of the seat assembly to transition the seat assembly to an expanded state according to an example implementation.

FIG. 18A depicts a partial cross-sectional view of the setting tool 1600, according to an example implementation, for purposes of illustrating forces that the tool 1600 exerts on the lower segment 410. It is noted that FIG. 18*a* depicts one half of the cross-section of the setting tool 1600 about the tool's longitudinal axis 1601, as can be appreciated by the skilled artisan.

Referring to FIG. 18A, an inclined, or sloped, surface 1820 of the vane 1608-1 and a sloped surface 1824 of the mandrel 1620 act on the upper segment 410 as illustrated in FIG. 18A. In particular, the sloped surface 1820 of the vane 1608-1 forms an angle $\alpha 1$ (with respect to the longitudinal axis 1601), which contacts an opposing sloped surface 1810 of the segment 410. Moreover, the sloped surface 1824 of the mandrel 1620 is inclined at an angle $\beta 1$ with respect to the longitudinal axis 1601. The sloped surface 1824 of the mandrel 1820, in turn, contacts an opposing sloped surface 1812 of the upper segment 410. The surfaces 1820 and 1824 have respective surface normals, which, in general, are pointed in opposite directions along the longitudinal axis 1601. Therefore, by relative movement of the rod 1602 in the illustrated uphole direction 1830, the surfaces 1820 and 1824 of the setting tool 1600 produce a net outward radial force 1834 on the segment 410, which tends to radially expand the upper segment 410. Moreover, the relative movement of the rod 1602 and mandrel 1620 produces a force 1832 that causes the segment 410 to longitudinally translate to a position to compress the segments 410 and 420 into a single layer.

Figure 19A:
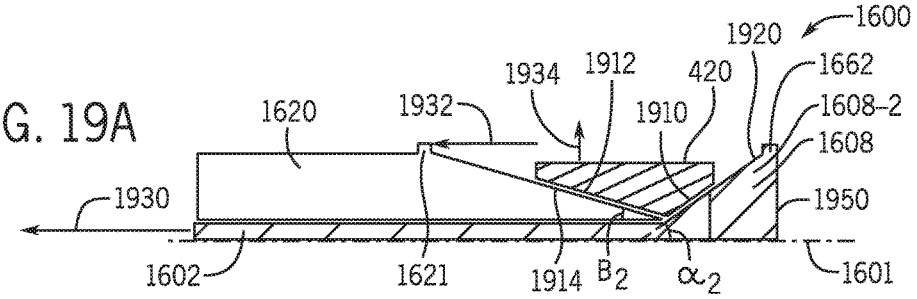
FIGS. 19A, 19B, 19C, 19D, 19E and 19F are cross-sectional views illustrating use of the setting tool to expand a lower segment of the seat assembly to transition the seat assembly to the expanded state according to an example implementation.

Referring to FIG. 19A, for the lower segment 420, the vane 1608-2 of the rod 1602 has a sloped surface 1920, which contacts a corresponding sloped surface 1910 of the lower segment 420; and the mandrel 1620 has a sloped surface 1914 that contacts a corresponding opposing sloped surface 1912 of the lower segment 420. As depicted in FIG. 19A, the slope surfaces 1914 and 1920 having opposing surface normals, which cause the relative movement between the rod 1602 and mandrel 1620 to produce a net radially outward force 1934 on the lower segment 410. Moreover, movement of the rod 1602 relative to the mandrel 1620 produces a longitudinal force 1932 to longitudinally translate the lower segment 420 into a position to compress the seat assembly 50 into a single layer. As shown in FIG. 19A, the sloped surfaces 1920 and 1914 have associated angles called "$\beta 2$" and "$\alpha 2$" with respect to the longitudinal axis 1601.

In accordance with example implementations, the $\alpha 1$ and $\alpha 2$ angles may be the same; and the $\beta 1$ and $\beta 2$ angles may be same. However, different angles may be chosen (i.e., the $\alpha 1$ and $\alpha 2$ angles may be different, as well as the $\beta 1$ and $\beta 2$ angles, for example), depending on the particular implementation. Having different slope angles involves adjusting the thicknesses and lengths of the segments of the seat assembly 50, depending on the purpose to be achieved. For example, by adjusting the different slope angles, the seat assembly 50 and corresponding setting tool may be designed so that the segments of the seat assembly are at the same height when the seat assembly 50 is fully expanded or a specific offset. Moreover, the choice of the angles may be used to select whether the segments of the seat assembly finish in an external circular shape or with specific radial offsets.

The relationship of the $\alpha$ angles (i.e., the $\alpha 1$ and $\alpha 2$ angles) relative to the $\beta$ angles (i.e., the $\beta 1$ and $\beta 2$ angles) may be varied, depending on the particular implementation. For example, in accordance with some implementations, the $\alpha$ angles may be less than the $\beta$ angles. As a more specific example, in accordance with some implementations, the $\beta$ angles may be in a range from one and one half times the $\alpha$ angle to ten times the $\alpha$ angle, but any ratio between the angles may be selected, depending on the particular implementation. In this regard, choices involving different angular relationships may depend on such factors as the axial displacement of the rod 1602, decisions regarding adapting the radial and/or axial displacement of the different layers of the elements of the seat assembly 50; adapting friction forces present in the setting tool and/or seat assembly 50; and so forth.

Figure 18B:
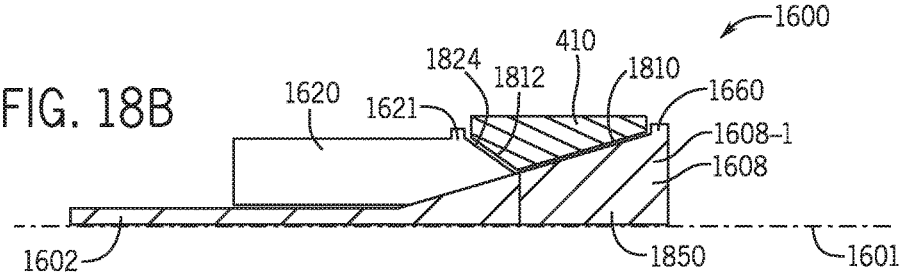

FIG. 18B depicts further movement (relative to FIG. 18A) of the rod 1602 with respect to the upper segment 410 mandrel 1620, resulting in full radial expansion of the upper seat segment 410; and FIG. 18B also depicts stop shoulders 1621 and 1660 that may be used on the mandrel 1620 and rod 1602, in accordance with some example implementations. In this manner, for the state of the setting that is depicted in FIG. 18A, relative travel between the rod 1602 and the mandrel 1620 is halted, or stopped, due to the upper end of the upper seat segment 410 contacting a stop shoulder 1621 of the mandrel 1620 and a lower stop shoulder 1660 of the vane 1608-2 contacting the lower end of segment 410. Likewise, FIG. 19B illustrates full radial expansion of the lower seat segment 420, which occurs when relative travel between the rod 1602 and the mandrel 1620 is halted due to the segment 420 resting between a stop shoulder 1625 of the mandrel 1620 and a stop shoulder 1662 of the vane 1608-2.

Figure 19B:
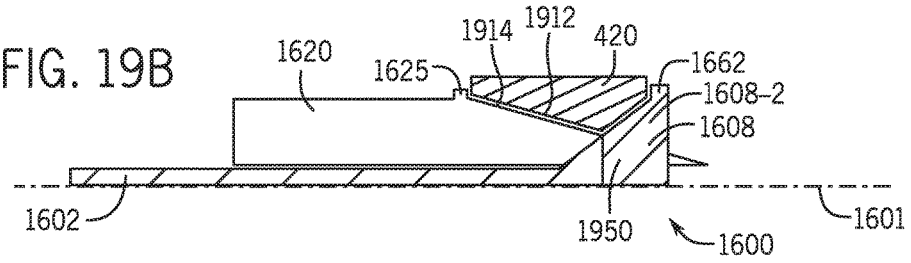

For the setting tool 1600 that is depicted in FIGS. 18A-19B, the tool 1600 includes a bottom compression member that is attached to the lower end of the mandrel 1620 and has corresponding member parts 1850 (contacting the segments 410) and 1950 (contacting the segments 420). In example with example implementations, compression members 1850 and 1950 may be the same part but are depicted in the figures at two different cross-sections for clarity. Thus, as shown in FIGS. 18A and 18B, the vane 1608-1 contains a compression member part 1850; and the vane 1608-2 depicted in FIGS. 19A and 19B depicts a compression member part 1950. In accordance with further implementations disclosed herein, the mandrel of a setting tool may not include such an extension. Moreover, although specific implementations are disclosed herein in which the rod of the setting tool moves with respect to the mandrel, in further implementations, the mandrel may move with respect to the rod. Thus, many variations are contemplated, which are within the scope of the appended claims.

Figure 18C:
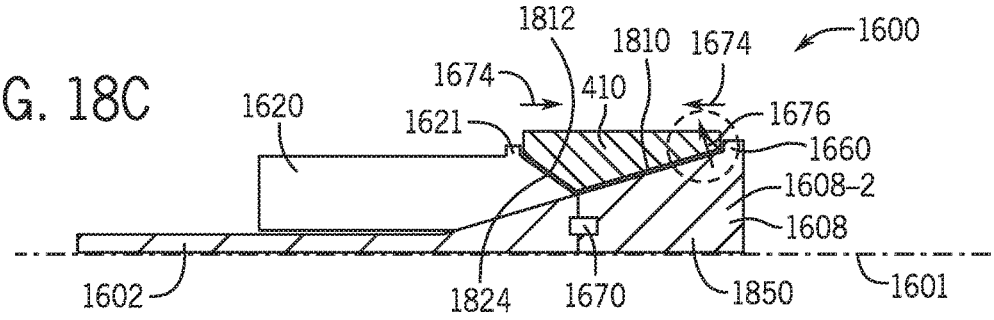
Figure 19C:
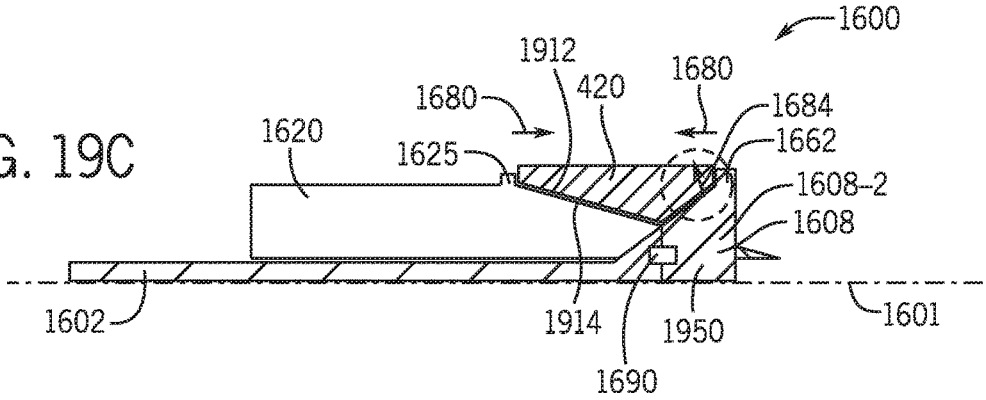

In accordance with further implementations, the bottom compression member of the rod 1602 may be attached to the remaining portion of the rod using one or more shear devices. In this manner, FIG. 18C depicts the compression member part 1850 being attached to the rest of the vane 1608-1 using a shear device 1670, such as a shear screw, for example. Likewise, FIG. 19C depicts the compression member part 1950 being attached to the remainder of the vane 1608-2 using a corresponding shear device 1690. The use of the compression member, along with the shear device(s) allows the setting tool to leave the compression member downhole to, in conjunction with the seat assembly 50, form a permanently-set seat in the well.

More specifically, the force that is available from the setting tool 1600 actuating the rod longitudinally and the force-dependent linkage that is provided by the shear device, provide a precise level of force transmitted to the compression member. This force, in turn, is transmitted to the segments of the seat assembly 50 before the compression member separates from the rod 1602. The compression member therefore becomes part of the seat assembly 50 and is released at the end of the setting process to expand the seat assembly 40. Depending on the particular implementation, the compression piece may be attached to the segments or may be a separate piece secured by one or more shear devices.

Thus, as illustrated in FIGS. 18C and 19B, through the use of the compression pieces, additional force, i.e., additional longitudinal forces 1674 (FIG. 18C) and 1680 (FIG. 19C); or additional radial forces 1676 (FIG. 18C) or 1684 (FIG. 19C); or a combination of both, may be applied to the seat assembly 50 to aid in expanding the seat assembly.

The above-described forces may be transmitted to a self-locking feature and/or to an anti-return feature. These features may be located, for example, on the side faces of the seat assembly's segments and/or between a portion of the segments and the compression piece.

In accordance with some implementations, self-locking features may be formed from tongue and groove connections, which use longitudinally shallow angles (angles between three and ten degrees, for example) to obtain a self-locking imbrication between the parts due to contact friction.

Anti-return features may be imparted, in accordance with example implementations, using, for example, a ratchet system, which may be added on the external faces of a tongue and groove configuration between the opposing pieces. The ratchet system may, in accordance with example implementations, contain spring blades in front of anchoring teeth. The anti-return features may also be incorporated between the segment (such as segment 410) and the compression member, such as compression member 1850. Thus, many variations are contemplated, which are within the scope of the appended claims.

FIGS. 18D, 19D, 18E, 19E, 18F and 19F depict using of the bottom compression member along with the shear devices, in accordance with an example implementation.

Figure 18D:
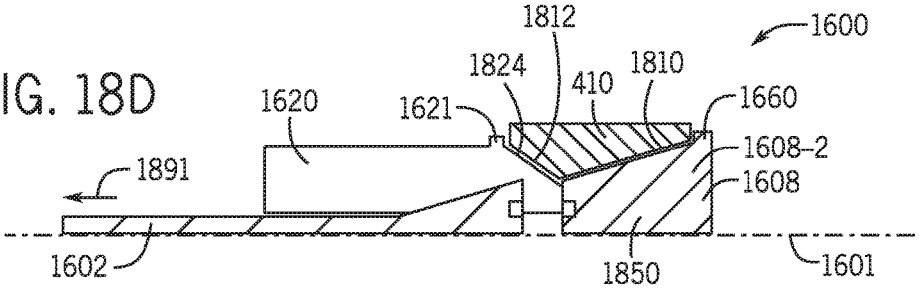
Figure 19D:
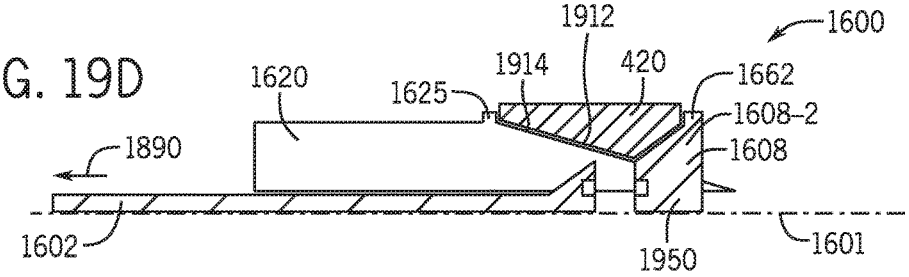
Figure 18E:
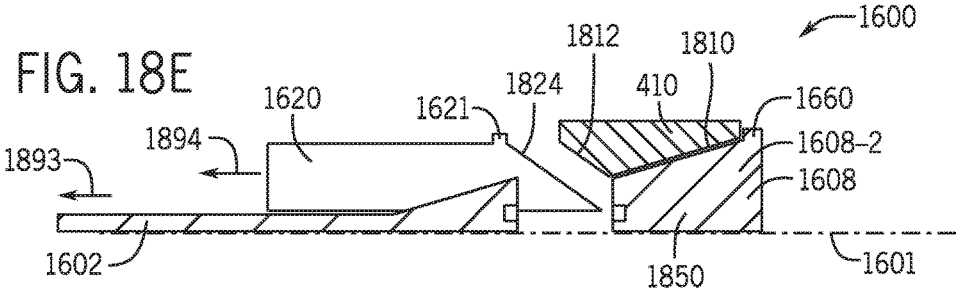
Figure 19E:
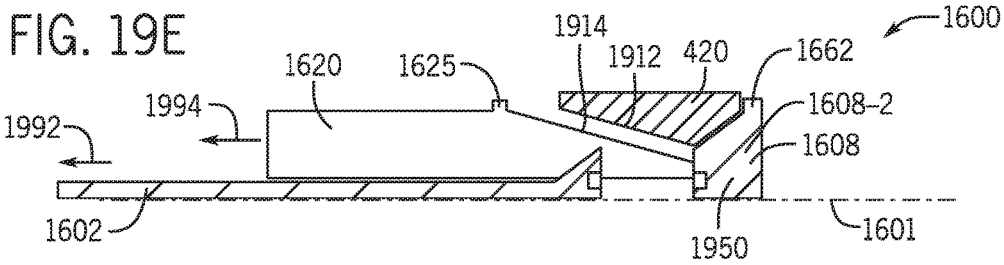
Figure 18F:
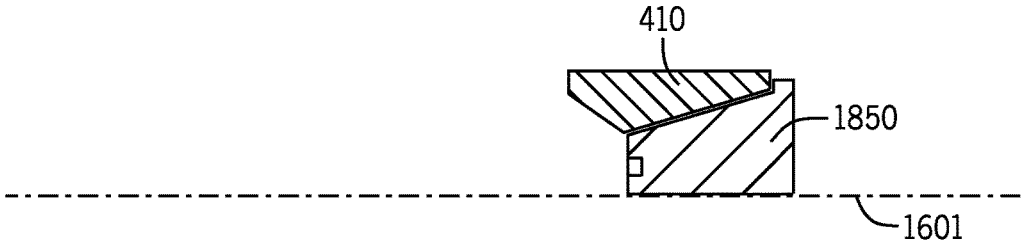
Figure 19F:
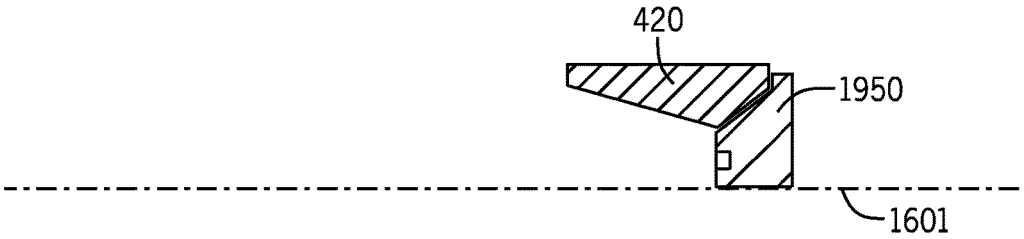
Figure 21A:
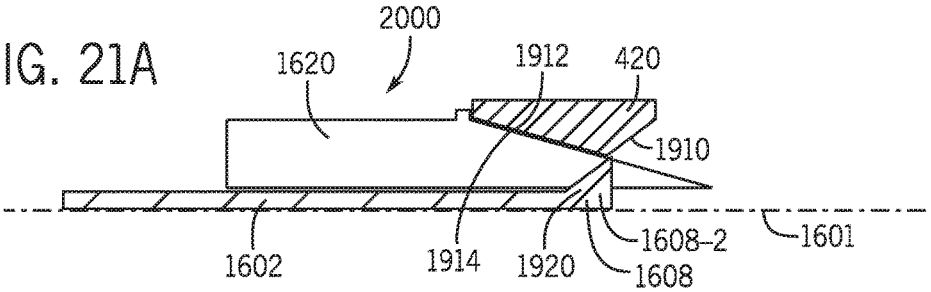
FIGS. 21A, 21B, 21C and 21D are cross-sectional views illustrating use of a setting tool to expand a lower segment of the seat assembly to transition the seat assembly to the expanded state according to a further example implementation.
Figure 21B:
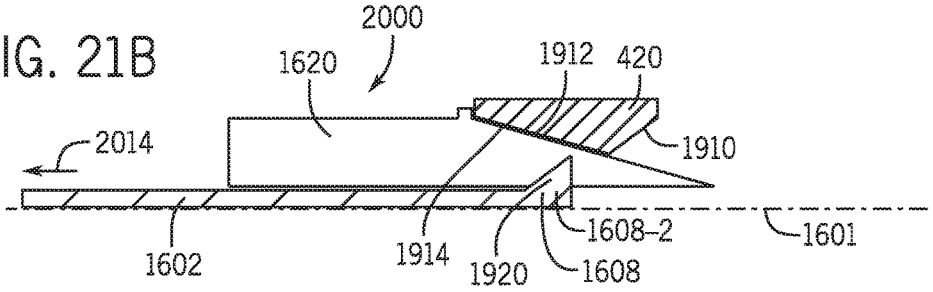
Figure 21C:
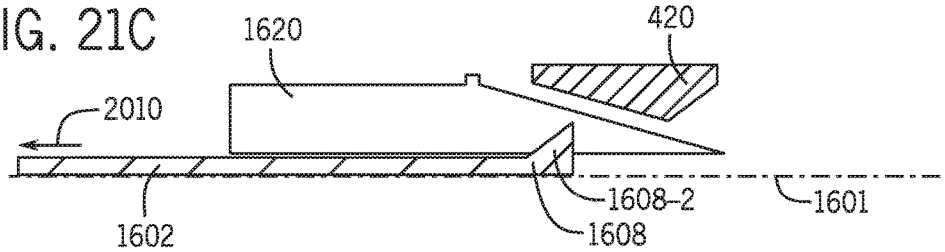

More specifically, FIGS. 18D and 19D depict separation of the compression member parts 1850 (FIG. 18D) and 1950 (FIG. 18E) from the rod 1602, thereby releasing the compression member from the rest of the setting tool, as illustrated in FIGS. 18E and 19E. As depicted in FIGS. 18F and 19F, after removal of the remainder of the setting tool 1600, the segments 410 (FIG. 18F) and 420 (FIG. 19F) and corresponding compression member parts 1850 and 1950 remain in the well. Thus, as illustrated in FIG. 18F, the compression piece 1850 stands alone with the upper segment 410; and the compression piece 1950 (see FIG. 19F) stands alone with the lower segment 420.

In accordance with some implementations, as discussed above, the segments 410 and/or 420 of the seat assembly may contain anchors, or slips, for purposes of engaging, for example, a tubing string wall to anchor, or secure the seat assembly to the string.

In accordance with some implementations, the setting tool may contain a lower compression member on the rod, which serves to further expand radially the formed ring and further allow the ring to be transitioned from its expanded state back to its contracted state. Such an arrangement allows the seat assembly to be set at a particular location in the well, anchored to the location and expanded, a downhole operation to be performed at that location, and then permit the seat assembly to be retracted and moved to another location to repeat the process.

Figure 20A:
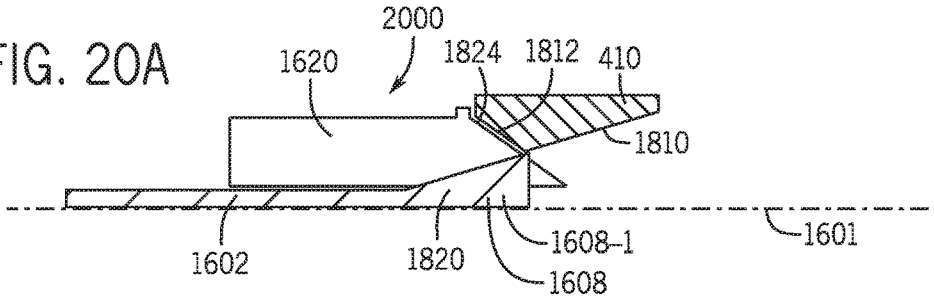
FIGS. 20A, 20B, 20C and 20D are cross-sectional views illustrating use of a setting tool to expand an upper segment of the seat assembly to transition the seat assembly to the expanded state according to a further example implementation.
Figure 20B:
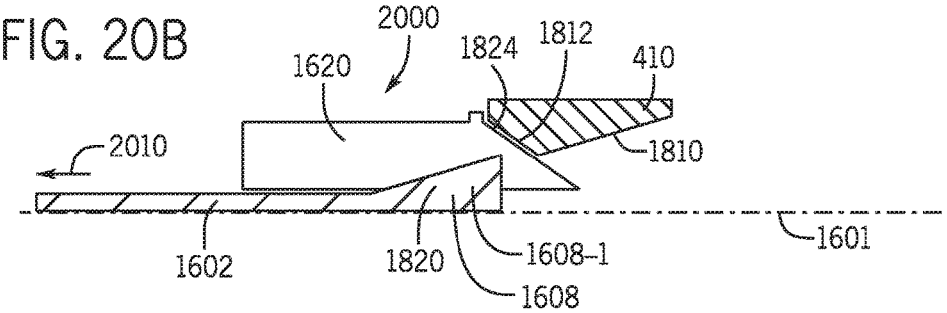
Figure 20C:
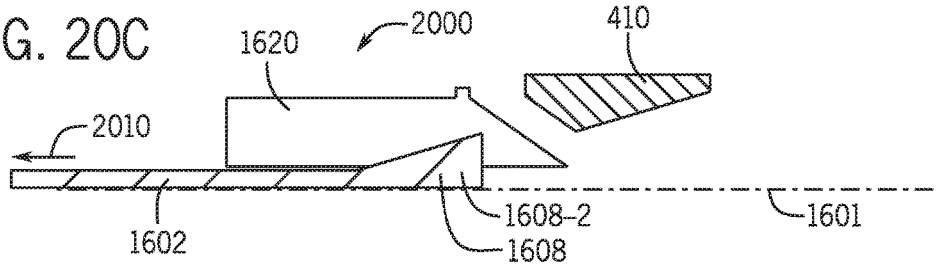
Figure 20D:
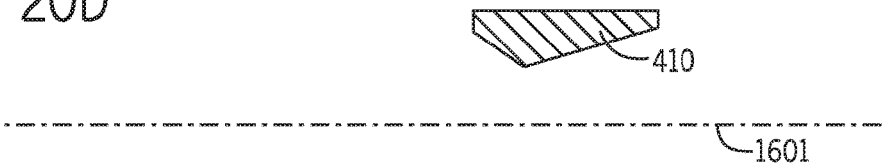
Figure 21D:
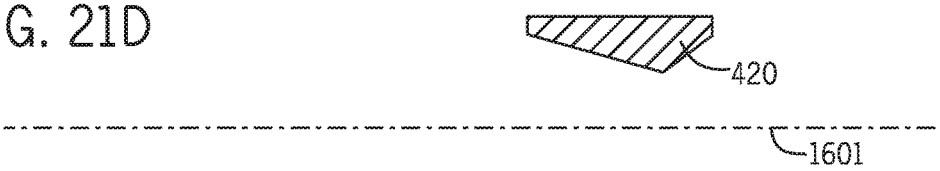

FIGS. 20A, 20B, 20C and 20D depict the actions of setting tool 2000 against the upper seat segment 410; and FIGS. 21A, 21B, 21C and 21D depict the actions of the setting tool 2000 against the lower seat segment 420. As shown, the setting tool 2000 does not have a lower compression member, thereby allowing the rod 1602 to be moved in a longitudinal direction (as illustrated by directions 210 of FIG. 20B and 2014 of FIG. 21B) to radially expand the segments 410 and 420 and leave the segments 410 and 420 in the well, as illustrated in FIGS. 20D and 21D.

Figure 22A:
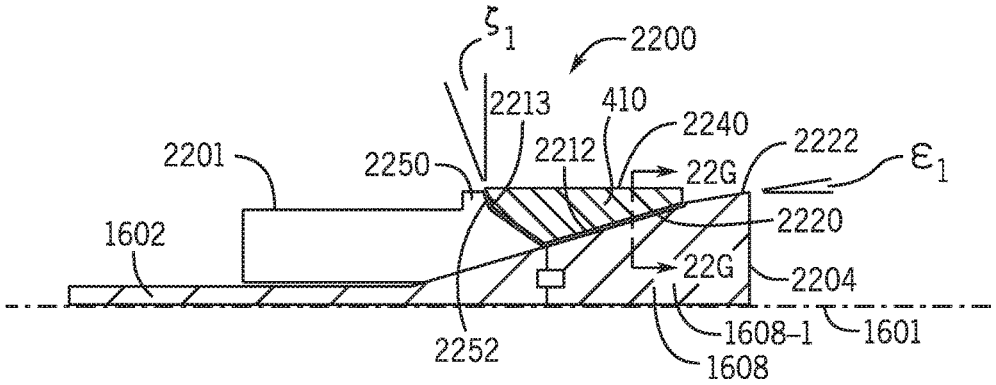
FIGS. 22A, 22B, 22C, 22D, 22E and 22F are cross-sectional views of a setting tool and a segmented seat assembly illustrating use of the setting tool to expand an upper segment of the seat assembly to transition the seat assembly to the expanded state according to an example implementation.

FIG. 22A depicts a seat assembly setting tool 2200 according to further implementations. For these implementations, a mandrel 2201 of the tool 2200 includes the above-described inclined faces to contact seat assembly segments. The mandrel 2201 also contains an end sloped segment on its outer diameter to ease the radial expansion of the segments while having a small axial movement for purposes of reducing friction and providing easier sliding movement. In this manner, as depicted in FIG. 22A, the mandrel 2201 contains a portion 2250 that has an associated sloped surface 2252 that engages a corresponding sloped surface 2213 of the upper seat segment 410. The sloped surface 2252 forms an associated angle (called "$\zeta_1$") with respect to the radial direction from the longitudinal axis 1601. Likewise, the portion 2250 may have a sloped surface 2253 (see FIG. 22F) that engages a corresponding sloped surface 2215 of the lower seat segment 420 and forms an angle (called "$\zeta_2$") with respect to the radial direction. The angles $\zeta_1$ and $\zeta_2$ may be, equal to or steeper than the steepest of the $\alpha$ angles (the $\alpha$1 and $\alpha$2 angles) and the $\beta$ angles (the $\beta$1 and $\beta$2 angles), in accordance with some implementations.

Figure 22B:
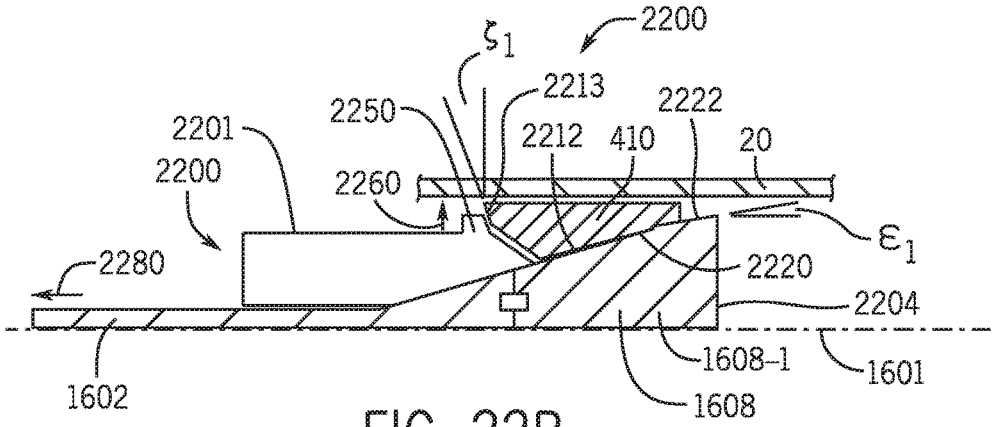
Figure 22C:
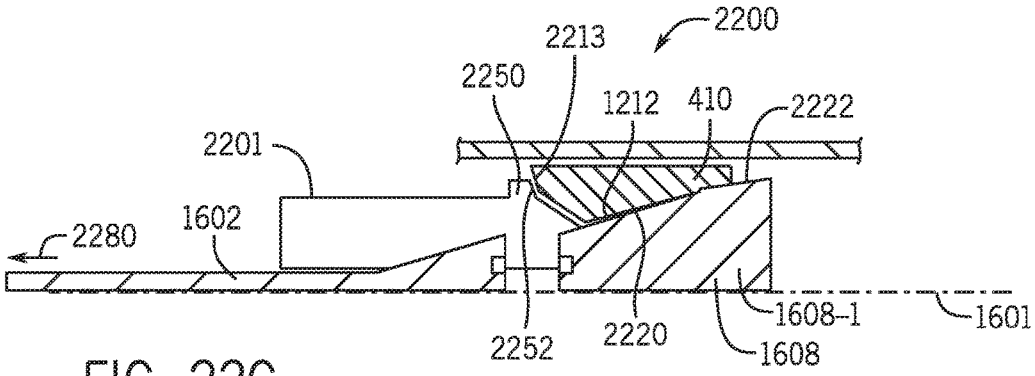

On the other side of the seat segments, an additional sloped surface may be added, in accordance with example implementations, in a different radial orientation than the existing sloped surface with the angle $\alpha$1 for the upper segment 410 and $\beta$1 for the lower segment 420. Referring to FIG. 22A, the tool 2200 includes a lower compression piece 2204 that includes a sloped surface 2220 having an angle $\epsilon$1 with respect to the longitudinal axis 1601. The angle $\epsilon$1 may be relatively shallow (a three to ten degree angle, for example, with respect to the longitudinal axis 1601) to obtain a self-locking contact between the upper seat segment 410 and the compression piece 2204. As depicted in the cross-section depicted in FIG. 22G, the upper seat segment 410 has sloped surfaces 2220 with the $\epsilon_1$ angle and a sloped surface 2280 with the $\alpha$1 angle. Referring to FIG. 22F, in a similar manner, the lower seat segment 420 may have surfaces that are inclined at angles $\alpha$2 and $\epsilon_2$. The $\epsilon_2$ angle may be relatively shallow, similar to the $\epsilon_1$ angle for purposes of obtaining a self-locking contact between the lower seat segment 420 and the compression piece.

Depending on the different slopes and angle configurations, some of the sloped surfaces may be combined into one surface. Thus, although the examples disclosed herein depict the surfaces as being separated, a combined surface due to an angular choice may be advantageous, in accordance with some implementations.

For the following example, the lower seat segment 420 is attached to, or integral with teeth, or slips 2292 (see FIG. 22H, for example), which engage the inner surface of the tubing string 20. The upper seat segment 410 may be attached to/integral with such slips, in accordance with further implementations and/or the seat segments 410 and 420 may be connected to slips; and so forth. Thus, many implementations are contemplated, which are with the scope of the appended claims.

Due to the features of the rod and mandrel, the setting tool 2200 may operate as follows. As shown in FIG. 22B, upon movement of the rod 1602 along a direction 2280, the upper seat segment 410 radially expands due to a resultant force along a radial direction 2260. At this point, the rod 1602 and compression piece 2204 remain attached. Referring to FIG. 22H, the lower seat segment 420 radially expands as well, which causes the slips 2292 to engage the tubing string wall. Upon further movement of the rod 1602 in the direction 2280, the compression piece 2204 separates from the remaining portion of the rod 1602, as illustrated in FIG. 22C. In a similar manner, referring to FIG. 22I, this separation also occurs in connection with the components engaging the lower seat segment 420.

Figure 22D:
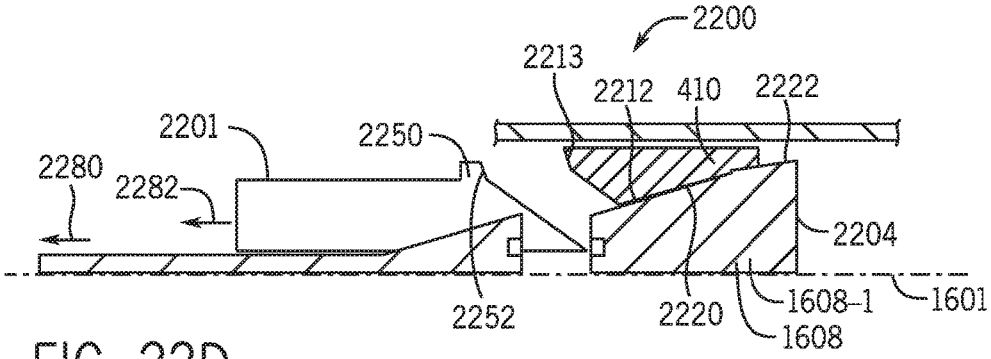
Figure 22E:
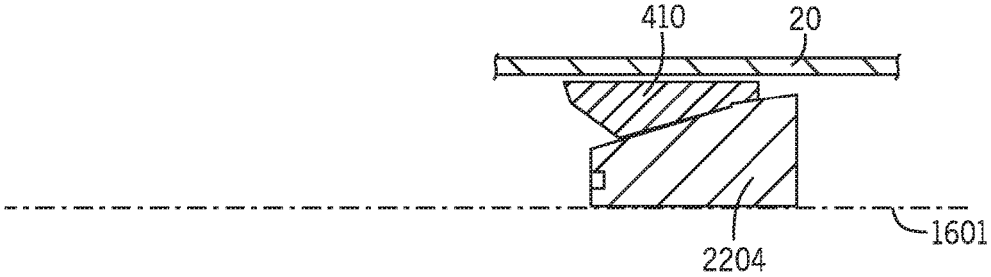
Figure 22F:
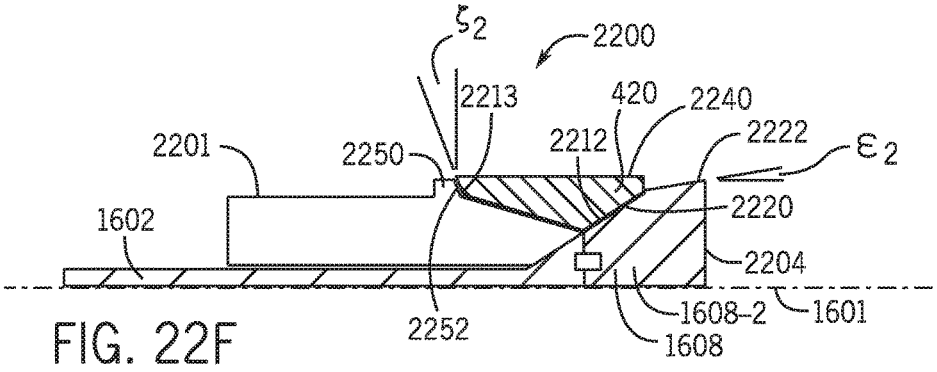
Figure 22G:
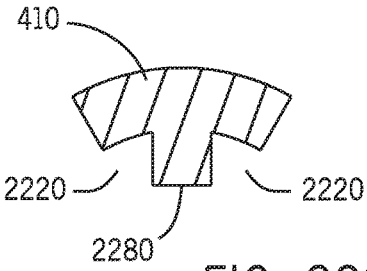
FIG. 22G is a cross-sectional view taken along line 22G-22G of FIG. 22A according to an example implementation.
Figure 22H:
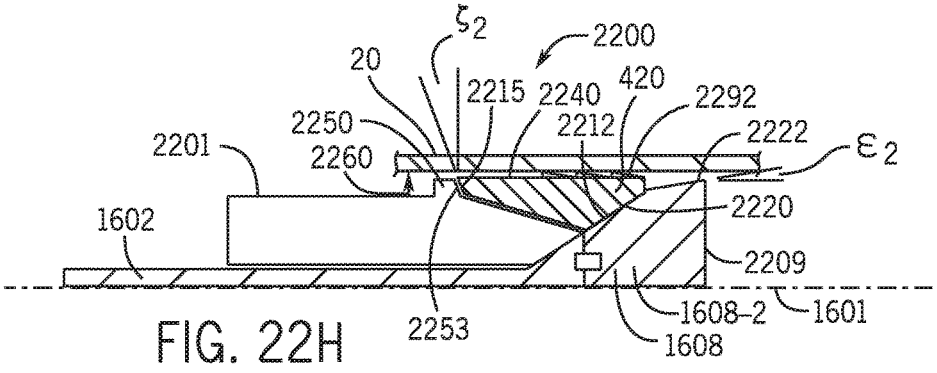
Figure 22I:
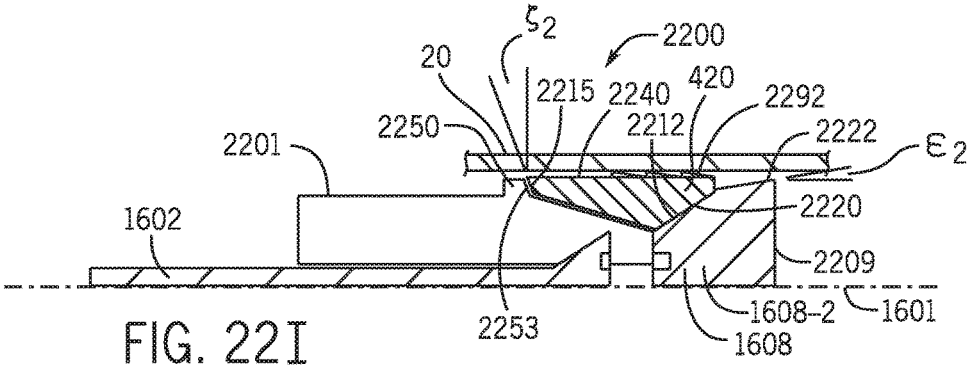
Figure 22J:
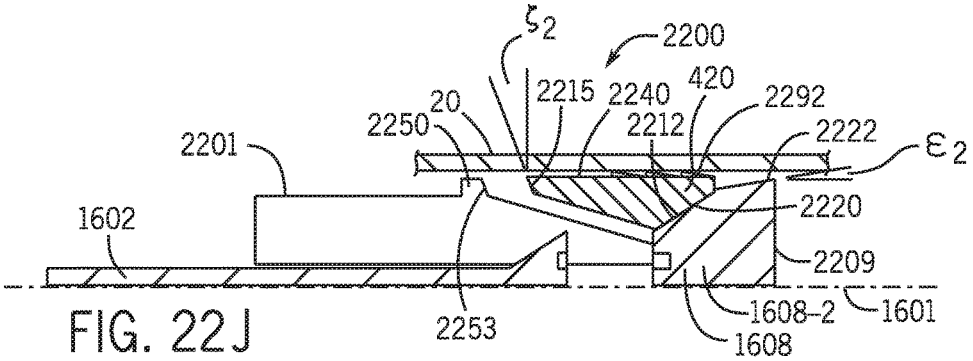
Figure 22K:
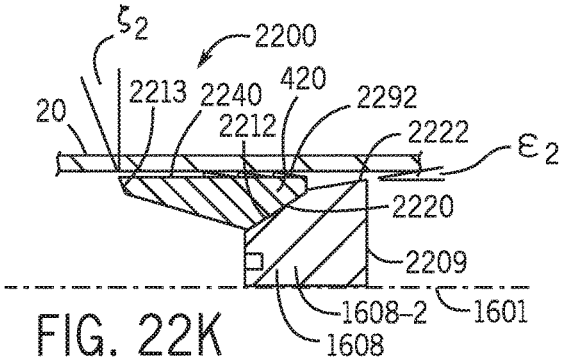

At this point, the segments are anchored, or otherwise attached, to the tubing string wall, so that, as depicted in FIGS. 22D and 22J, the remaining rod and mandrel may be further retracted uphole, thereby leaving the compression piece and segment down in the well, as further illustrated in FIGS. 22E and 22K.

Other implementations are contemplated, which are within the scope of the appended claims. For example, in accordance with some implementations, the segmented seat assembly may be deployed inside an expandable tube so that radial expansion of the segmented seat assembly deforms the tube to secure the seat assembly in place. In further implementations, the segmented seat assembly may be deployed in an open hole and thus, may form an anchored connection to an uncased wellbore wall. For implementations in which the segmented seat assembly has the slip elements, such as slip elements 2292 (see FIG. 22K, for example), the slip elements may be secured to the lower seat segments, such as lower seat segments 420, so that the upper seat segments 410 may rest on the lower seat segments 420 after the untethered object has landed in the seat of the seat assembly.

In example implementations in which the compression piece(s) are not separated from the rod to form a permanently-set seat assembly, the rod may be moved back downhole to exert radial retraction and longitudinal expansion forces to return the seat assembly back into its contracted state.

Figure 23:
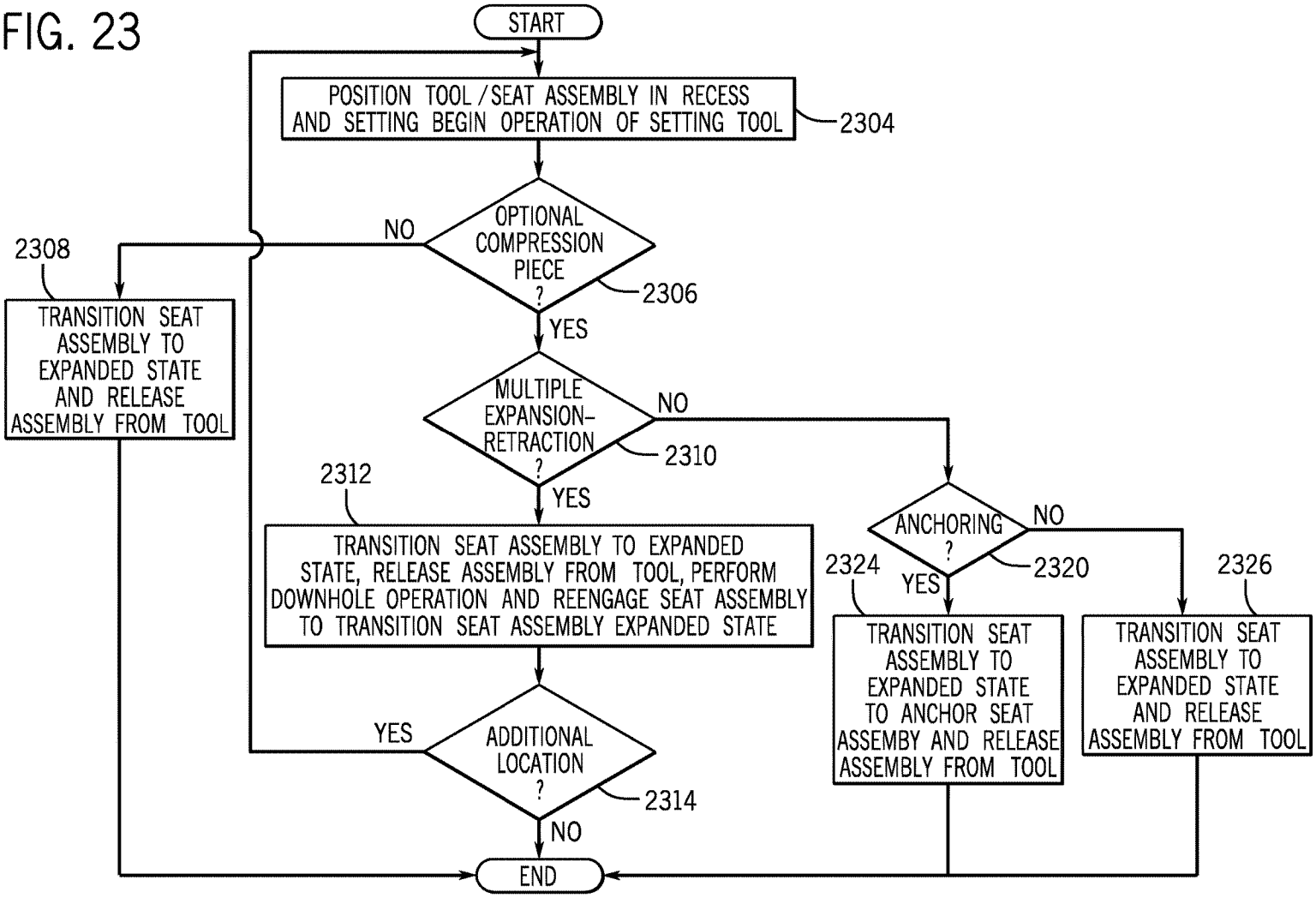
FIG. 23 is a flow diagram depicting a technique to use a setting tool to transition a segmented seat assembly between contracted and expanded states according to example implementations.

Thus, in general, a technique 2300 that is depicted in FIG. 23 may be performed in a well using a setting tool and a segmented seat assembly. Pursuant to the technique 2300, a tool and seat assembly is positioned in a recess of a tubing string (as an example) and movement of the tool is initiated, pursuant to block 2304. If the setting tool contains an optional compression piece (decision block 2306) and if multiple expansion and retraction is to be performed for purposes of performing multiple downhole operations (decision block 2310), then the technique 2300 includes transitioning the seat assembly to an expanded state, releasing the assembly from the tool, performing a downhole operation and then reengaging the seat assembly with the setting tool to transition the seat assembly back to the contracted state. If more downhole locations are to be performed (decision block 2314), then control transitions back to box 2304.

Otherwise, pursuant to the technique 2300, if the setting tool does not contain the compression piece (decision block 2306), then the technique 2300 includes transitioning the seat assembly to the expanded state and releasing the assembly from the tool, pursuant to block 2308. If the setting tool contains the compression piece but multiple expansions and retractions of the seat assembly is not to be used (decision block 2310), then use of the tool depends on whether anchoring (decision block 2320) is to be employed. In other words, if the seat assembly is to be permanently anchored, then the flow diagram 2300 includes transitioning the seat assembly to the expanded state to anchor the setting tool to the tubing string wall and releasing the assembly from the tool, thereby leaving the compression piece downhole with the seat assembly to form a permanent seat in the well. Otherwise, if anchoring is not to be employed, the technique 2300 includes transitioning the seat assembly to the expanded state and releasing the seat assembly from the tool, pursuant to block 2326, without separating the compression piece from the rod of the setting tool, pursuant to block 2326.

Figure 24A:
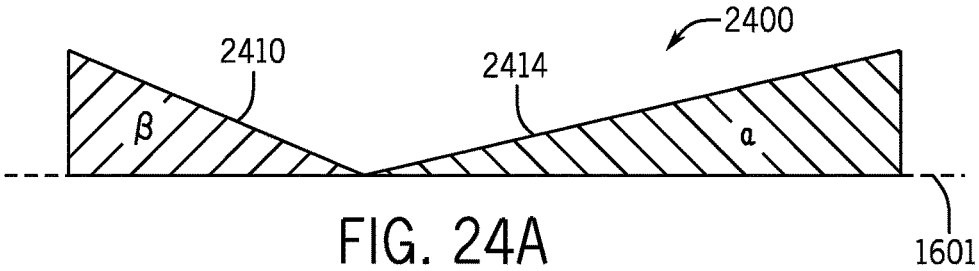
FIGS. 24A and 24B illustrate surfaces of the rod and mandrel of a seat assembly setting tool for a two layer seat assembly according to an example implementation.
Figure 24B:
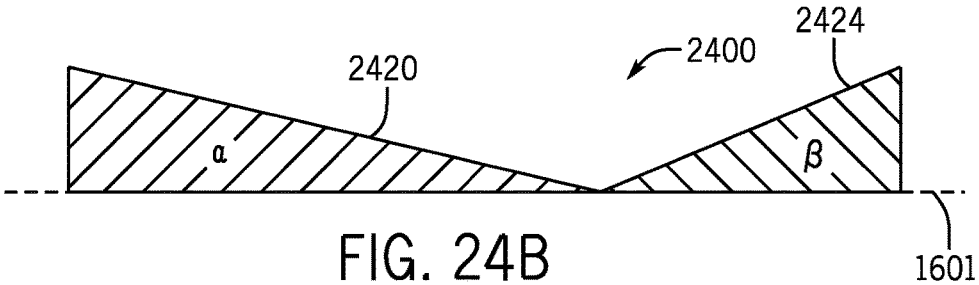
Figure 25A:
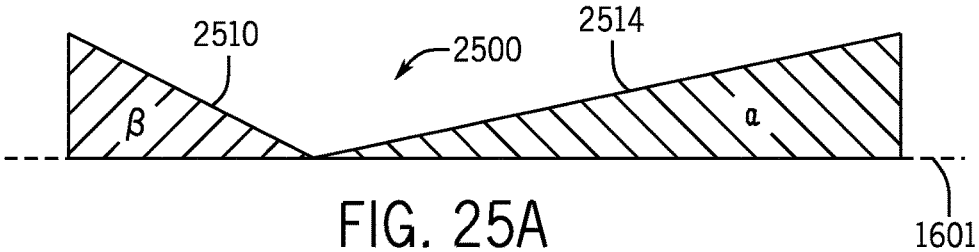
FIGS. 25A, 25B and 25C illustrate surfaces of the rod and mandrel of a seat assembly setting tool for a three layer seat assembly according to an example implementation.
Figure 25B:
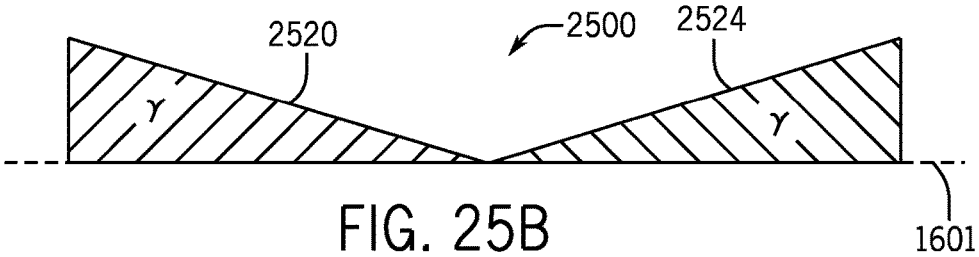
Figure 25C:
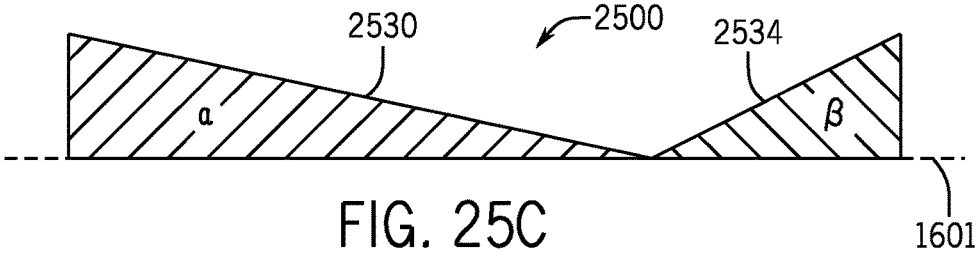
Figure 26A:
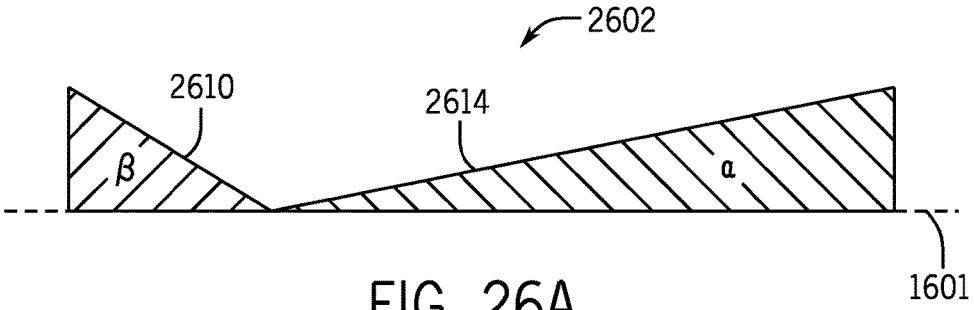
FIGS. 26A, 26B, 26C and 26D illustrate surfaces of the rod and mandrel of a seat assembly setting tool for a four layer seat assembly according to an example implementation.
Figure 26B:
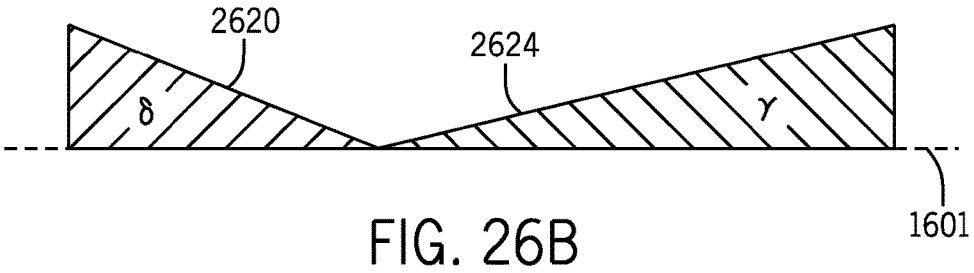
Figure 26C:
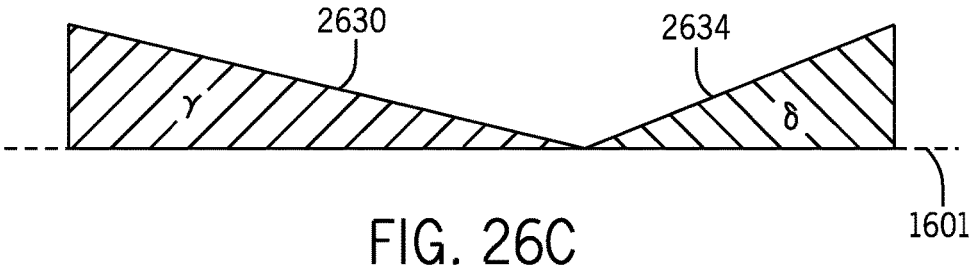
Figure 26D:
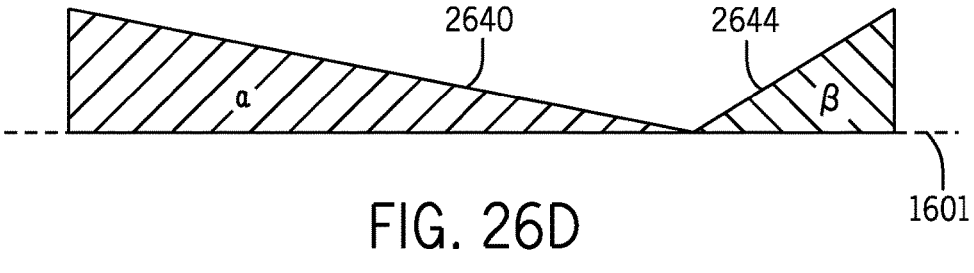

Many variations are contemplated, which are within the scope of the appended claims. For example, to generalize, implementations have been disclosed herein in which the segmented seat assembly has segments that are arranged in two axial layers in the contracted state of the assembly. The seat assembly may, however, have more than two layers for its segments in its contracted, in accordance with further implementations. Thus, in general, FIGS. 24A and 24B depict surfaces 2410 and 2414 (FIG. 24A) for an upper segment of a two layer seat assembly and corresponding surfaces 2420 and 2424 (FIG. 24B) for the lower segment of the two layer assembly. FIGS. 25A, 25B and 25C depict surfaces 2510 and 2514 (FIG. 25A), 2520 and 2524 (FIG. 25B), and 2530 and 2534 (FIG. 25C) for upper, intermediate and lower segments of a three layer seat assembly. FIGS. 26A (showing layers 2610 and 2614), 26B (showing layers 2620 and 2624), 26C (showing layers 2630 and 2634) and 26D (showing layers 2640 and 2644) depict surfaces of the rod and mandrel for upper-to-lower segments of a four layer segmented seat assembly. Thus, many variations are contemplated, which are within the scope of the appended claims.

While a limited number of examples have been disclosed herein, those skilled in the art, having the benefit of this disclosure, will appreciate numerous modifications and variations therefrom. It is intended that the appended claims cover such modifications and variations.

What is claimed is:

1. A method comprising:

deploying an assembly in a contracted state on a tool into a well, the assembly comprising segments adapted to be radially contracted in the contracted state and the segments being associated with a plurality of layers; and expanding the assembly downhole in the well using the tool to transition the assembly between the contracted state and an expanded state, wherein expanding comprises radially expanding the segments and longitudinally contracting the segments to compress the plurality of layers together along a longitudinal axis of the assembly;

deploying an untethered object into the well;

receiving the untethered object in the assembly in the expanded state; and performing a downhole operation using the received untethered object in the assembly.

2. The method of claim 1, wherein the tool comprises a rod and a mandrel, and using the tool comprises:

moving the rod relative to the mandrel of the tool; and contacting the segments with surfaces of the mandrel to transition the assembly between the contracted state and the expanded state.

3. The method of claim 2, wherein the using the tool further comprises:

contacting a given segment of the segments with a sloped surface of the rod; and contacting the given segment with a sloped surface of the mandrel.

4. The method of claim 3, wherein using the tool further comprises:

using the motion of the rod relative to the mandrel to disengage the tool from the given segment in a sequence that includes removing contact between the given segment and one of the sloped surface of the rod and the sloped surface of the mandrel, and removing contact between the given segment and the other of the one of the sloped surface of the rod and the sloped surface of the mandrel.

5. The method of claim 1, wherein using the tool further comprises positioning the tool inside a recess of a tubing string.

6. The method of claim 1, wherein using the tool comprises anchoring the assembly to a wall of an open borehole wall or a tubing string wall.

7. The method of claim 1, wherein using the tool comprises arranging outer surfaces from the segments to form a unitary outer surface envelope for the assembly in the expanded state.

8. The method of claim 7, wherein the envelope comprises an envelope shaped as a polygon or an ellipse.

9. The method of claim 1, further comprising dissolving at least part of at least one of the assembly or at least part of the received untethered object after the downhole operation.

10. A tool comprising:

a mandrel comprising a first set of surfaces adapted to contact segments of an assembly; and a rod adapted to travel relative to the mandrel, the rod comprising a second set of surfaces adapted to contact the segments of the assembly, wherein the mandrel and rod are adapted to contact the segments with the first and second sets of surfaces to exert forces on the segments of the assembly in response to travel of the rod relative to the mandrel, the travel of the rod relative to the mandrel transitions the assembly between a contracted state in which the segments are radially contracted and an expanded state in which the segments are radially expanded and longitudinally contracted, and the rod and mandrel are further adapted to disengage the first and second sets of surfaces from the segments in response to the assembly reaching the expanded state.

11. The tool of claim 10, further comprising:

a compression member to cause a compression force to be exerted on the assembly in response to the travel of the rod relative to the mandrel.

12. The tool of claim 11, further comprising a ratchet to secure a position of at least one of the segments or secure a position of the compression member.

13. The tool of claim 10, wherein the mandrel comprises:

a first set of members;

a second set of member; and shear devices to connect the first set of members to the second set of members and release the first set of members from the second set of members in response to the assembly reaching the expanded state.

14. A system comprising:

a tubing string;

an untethered object;

a seat assembly comprising segments adapted to:

be configured in a contracted state in which the segments are radially contracted and arranged in a plurality of layers; and be configured in an expanded state in which the segments are radially expanded and longitudinally contracted to compress the plurality of layers along a longitudinal axis of the seat assembly; and a tool adapted to mechanically engage the seat assembly and transition the seat assembly between the contracted and expanded states, wherein:

the seat assembly is adapted to be deployed inside the tubing string and operated by the tool to anchor the seat assembly to the tubing string at a selected downhole location, the seat assembly is adapted to form a seat in the expanded state, and the untethered object is adapted to be deployed in the passageway and received in a seat of the seat assembly.

15. The system of claim 14, wherein at least part of the seat assembly or at least part of the object comprises a dissolvable material.

16. The system of claim 14, wherein the tool is adapted to mechanically engage the seat assembly to transition the seat assembly between the contracted and expanded states in response to axial movement of the tool along the string.

17. The system of claim 14, further comprising a slip disposed on at least one of the segments to anchor the at least one segment in place in the well.

* * * * *